US011852090B2

(12) United States Patent
Takada et al.

(10) Patent No.: US 11,852,090 B2
(45) Date of Patent: Dec. 26, 2023

(54) VEHICLE CONTROL SYSTEM

(71) Applicant: Mazda Motor Corporation, Hiroshima (JP)

(72) Inventors: Takefumi Takada, Aki-gun (JP); Yuki Ishiyama, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 108 days.

(21) Appl. No.: 17/669,621

(22) Filed: Feb. 11, 2022

(65) Prior Publication Data

US 2022/0316415 A1 Oct. 6, 2022

(30) Foreign Application Priority Data

Mar. 30, 2021 (JP) ..... 2021-057189

(51) Int. Cl.
*F02D 41/10* (2006.01)
*F02D 41/04* (2006.01)
*F02D 41/02* (2006.01)

(52) U.S. Cl.
CPC ..... *F02D 41/10* (2013.01); *F02D 41/0225* (2013.01); *F02D 41/045* (2013.01); *F02D 2200/50* (2013.01); *F02D 2200/602* (2013.01); *F02D 2200/702* (2013.01); *F02D 2250/18* (2013.01)

(58) Field of Classification Search
CPC .... F02D 41/10; F02D 41/0225; F02D 41/045; F02D 2200/50; F02D 2200/602; F02D 2200/702; F02D 2250/18; F02D 2200/1004; F02D 2200/501
See application file for complete search history.

(56) References Cited

U.S. PATENT DOCUMENTS 9,581,091 B2 * 2/2017 Takeyoshi ..... F02D 41/0002
9,944,180 B2 * 4/2018 Yagi ..... F02D 11/105
9,964,059 B2 * 5/2018 Yagi ..... F02D 29/02
9,964,060 B2 * 5/2018 Yagi ..... F02D 29/02
(Continued)

FOREIGN PATENT DOCUMENTS

EP 1443193 A1 * 8/2004 ..... B60K 31/04
JP 2016176388 A 10/2016

*Primary Examiner* — Kurt Philip Liethen
(74) *Attorney, Agent, or Firm* — Alleman Hall Creasman & Tuttle LLP

(57) ABSTRACT

A vehicle control system includes an accelerator sensor which detects an accelerator opening, and a processor which sets a target acceleration of a vehicle based on the detected accelerator opening, sets a target torque of a drive source based on the set target acceleration, and controls the drive source to generate the set target torque. In a case where the target acceleration at a time when the accelerator opening is increased is set as a depression-increasing target acceleration and the target acceleration at a time when the accelerator opening is decreased is set as a pedal-returning target acceleration, under the same condition of the accelerator opening, the processor sets the target acceleration such that the depression-increasing target acceleration and the pedal-returning target acceleration are different from each other in a predetermined range of an upper limit acceleration or less and a lower limit acceleration or greater.

14 Claims, 16 Drawing Sheets

(56) References Cited

U.S. PATENT DOCUMENTS

| | | | | |
|---|---|---|---|---|
| 2001/0013329 | A1* | 8/2001 | Matsumoto | F02D 41/307<br>123/436 |
| 2014/0180554 | A1* | 6/2014 | Takahashi | B60W 30/143<br>701/70 |
| 2016/0273469 | A1* | 9/2016 | Takeyoshi | F02D 41/10 |
| 2016/0341139 | A1* | 11/2016 | Yagi | F02D 29/02 |
| 2017/0327102 | A1* | 11/2017 | Yamazaki | F02D 41/107 |
| 2018/0186352 | A1* | 7/2018 | Goto | B60T 8/1769 |
| 2021/0199059 | A1* | 7/2021 | Yamane | B60W 30/20 |

* cited by examiner

VEHICLE CONTROL SYSTEM

TECHNICAL FIELD

The present disclosure relates to a system for controlling a vehicle including a drive source which generates motive power for traveling and an accelerator pedal to be operated by a driver.

BACKGROUND ART

Conventionally, a technique has been known which controls a drive source of a vehicle in accordance with an operation of an accelerator pedal. For example, the following JP2016-176388A discloses a control apparatus including an accelerator opening sensor which detects an opening of an accelerator pedal (accelerator opening), a target acceleration setting unit which sets a target acceleration of a vehicle based on the detected accelerator opening, and an engine controller which controls an engine such that the set target acceleration is realized.

SUMMARY OF INVENTION

Problems to be Solved by the Invention

In JP2016-176388A, although a target acceleration is set to increase as an accelerator opening becomes wider, in a range where the accelerator opening is approximately intermediate or wider, a slope of a change in the target acceleration with respect to a change in the accelerator opening (operation gain) tends decrease toward a wider opening side. There has been a problem that when the operation gain lowers on a wide opening side, particularly in a circumstance where a driver deeply depresses an accelerator pedal and thereafter slightly returns the accelerator pedal, it becomes difficult for an acceleration change (behavior change) of a vehicle to be transmitted to a driver. As a measure against such a problem, employment of control is suggested, the control making the target acceleration under a condition where the acceleration opening is the same become different between when depression of the accelerator pedal is increased and when the accelerator pedal is returned, that is, hysteresis control. However, when the difference in acceleration characteristics between when depression of the accelerator pedal is increased and when the accelerator pedal is returned is enlarged by the hysteresis control, discomfort of the driver might be increased.

The present disclosure has been made in consideration of the above circumstances, and an object thereof is to provide a vehicle control system that is capable of reducing discomfort of a driver while employing hysteresis control which can give adequate responsiveness to the driver who operates an accelerator pedal.

Means for Solving the Problems

To solve the above problems, the present disclosure provides a system for controlling a vehicle which including a drive source which generates motive power for traveling and an accelerator pedal to be operated by a driver, the system including an accelerator sensor which detects an accelerator opening as an opening of the accelerator pedal, and a processor configured to execute a target acceleration setting unit which sets a target acceleration of the vehicle based on the accelerator opening detected by the accelerator sensor, a target torque setting unit which sets a target torque of the drive source based on the target acceleration set by the target acceleration setting unit, and a drive source controller which controls the drive source to generate the target torque set by the target torque setting unit. In a case where the target acceleration at a time when the accelerator opening is increased is set as a depression-increasing target acceleration and the target acceleration at a time when the accelerator opening is decreased is set as a pedal-returning target acceleration, under the same condition of the accelerator opening, the target acceleration setting unit sets the target acceleration such that the depression-increasing target acceleration and the pedal-returning target acceleration are different from each other in a range of an upper limit acceleration or less and a lower limit acceleration or greater, the range being predetermined.

According to the present disclosure, the depression-increasing target acceleration as the target acceleration of the vehicle at a time when the accelerator opening is increased and the pedal-returning target acceleration as the target acceleration of the vehicle at a time when the accelerator opening is decreased are set to be different from each other under the same condition of the accelerator opening, and an output torque of the drive source is controlled based on the target acceleration having such hysteresis characteristics. Thus, adequate responsiveness (a sense that the acceleration adequately changes) can be given to the driver when depression of the accelerator pedal is increased and when the accelerator pedal is returned. Furthermore, because an upper limit and a lower limit are given to the target acceleration in advance and the difference between the depression-increasing target acceleration and the pedal-returning target acceleration is thereby adequately restricted, the accelerator opening to obtain the same acceleration can be prevented from being largely different between a depression-increasing situation and a pedal-returning situation, and discomfort which can be given to the driver by the difference can be reduced.

The target acceleration setting unit preferably executes a control (hysteresis control) which causes the depression-increasing target acceleration and the pedal-returning target acceleration to be different in an accelerator opening range of a first opening or more and a second opening or less, the accelerator opening range being decided in advance, and in a case where a difference between the upper limit acceleration and the lower limit acceleration is set as an upper-lower limit difference, the target acceleration setting unit preferably sets the upper limit acceleration and the lower limit acceleration such that the upper-lower limit difference becomes zero when the accelerator opening is the first opening or the second opening and the upper-lower limit difference is enlarged as the accelerator opening becomes closer to an intermediate value between the first opening and the second opening.

With this configuration, the difference between the depression-increasing target acceleration and the pedal-returning target acceleration can continuously be changed in a specific accelerator opening range, and the target acceleration can smoothly be changed in accordance with the accelerator opening.

The vehicle control system preferably further includes a gradient sensor which detects a road surface gradient as a gradient of a traveling road of the vehicle, and the target acceleration setting unit preferably sets the upper limit acceleration and the lower limit acceleration such that the upper-lower limit difference diminishes as the road surface gradient detected by the gradient sensor becomes larger.

When an accelerator opening necessary for causing the vehicle to travel at a constant speed is set as an equilibrium opening, hypothetically in a case where the upper-lower limit difference (the difference between the upper limit acceleration and the lower limit acceleration) is evenly set regardless of the road surface gradient, in hill-climbing traveling of the vehicle, the difference in the equilibrium opening between when depression of the accelerator pedal is increased and when the accelerator pedal is returned is likely to be enlarged. On the other hand, in a case where the upper-lower limit difference is diminished as the road surface gradient is larger, as in the aforementioned configuration, because the difference, which can occur in hill-climbing traveling, in the equilibrium opening between the depression-increasing situation and the pedal-returning situation can be diminished, discomfort which the driver can give in hill-climbing traveling can be reduced, and operability of the accelerator pedal in hill-climbing traveling can be improved.

When an absolute value of a change rate of the accelerator opening is less than a predetermined threshold value, the target acceleration setting unit preferably sets the target acceleration such that an internal ratio of the target acceleration to the upper limit acceleration and the lower limit acceleration is retained at the same value as a previous value.

The fact that the absolute value of the change rate of the accelerator opening is small represents an intention of the driver of gently changing the acceleration of the vehicle. In the above configuration, because the target acceleration is set in accordance with the same internal ratio as the previous internal ratio in such a case, a sudden change in the acceleration of the vehicle can be avoided, and the driver can be prevented from feeling discomfort due to an unintended behavior change of the vehicle.

Advantageous Effects of Invention

As described above, a vehicle control system of the present disclosure can reduce discomfort of a driver while employing hysteresis control which can give adequate responsiveness to the driver who operates an accelerator pedal.

MODE FOR CARRYING OUT THE INVENTION

(1) General Configuration of System

Figure 1:
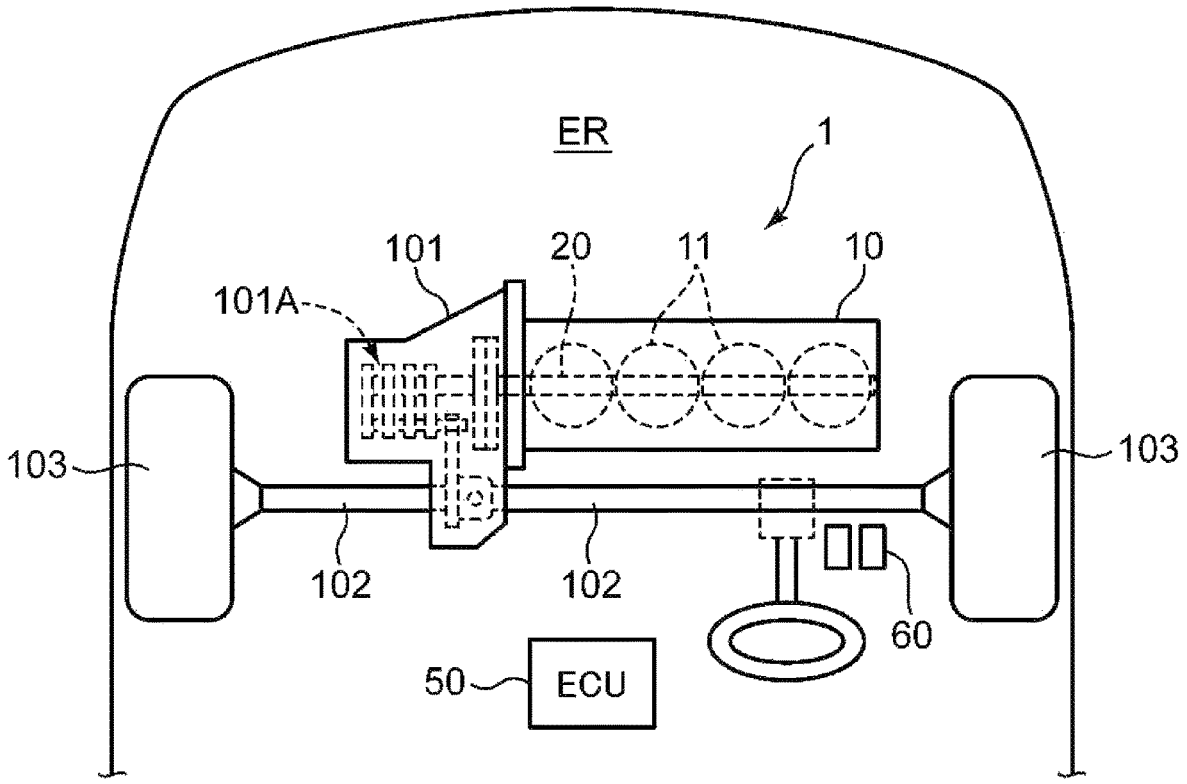
FIG. 1 is a diagram schematically illustrating a specific example of a vehicle to which a vehicle control system of the present disclosure is applied.

FIG. 1 is a diagram for explaining a preferable embodiment of the present disclosure and is a diagram schematically illustrating a specific example of a vehicle to which a vehicle control system of the present disclosure is applied. As illustrated in FIG. 1, the vehicle includes an engine 1 installed in an engine room ER, a transmission 101 coupled with a crankshaft 20 as an output shaft of the engine 1, a pair of drive shafts 102 coupled with the transmission 101, and a pair of wheels 103 mounted on end portions of the respective drive shafts 102 on vehicle-width-direction outer sides. Rotation (output rotation) of the crankshaft 20 of the engine is transmitted to the drive shafts 102 and the wheels 103 while a speed of the rotation is changed by the transmission 101. That is, the engine 1 installed in the vehicle of the present embodiment is a generation source of motive power (motive power source) for traveling of the vehicle and rotates and drives the wheels 103 via the transmission 101 and the drive shafts 102.

A gear mechanism 101A is built in the transmission 101. The gear mechanism 101A is a mechanism which is capable of achieving a plurality of gear stages (for example, first speed to sixth speed) whose transmission gear ratios are different and couples the crankshaft 20 (output shaft) of the engine 1 and the pair of drive shafts 102 with each other such that they move in an inter-connected manner. Output rotation of the engine 1 is transmitted to the wheels 103 while a speed of the output rotation is changed at the transmission gear ratio corresponding to the gear stage achieved by the gear mechanism 101A of the transmission 101. Here, the transmission 101 is a manual transmission (MT) which changes the gear stages while receiving a manual operation by the driver. However, an automatic transmission (AT) which automatically changes gear stages in accordance with a driving condition of the vehicle or the engine 1 may be used as the transmission 101.

Figure 2:
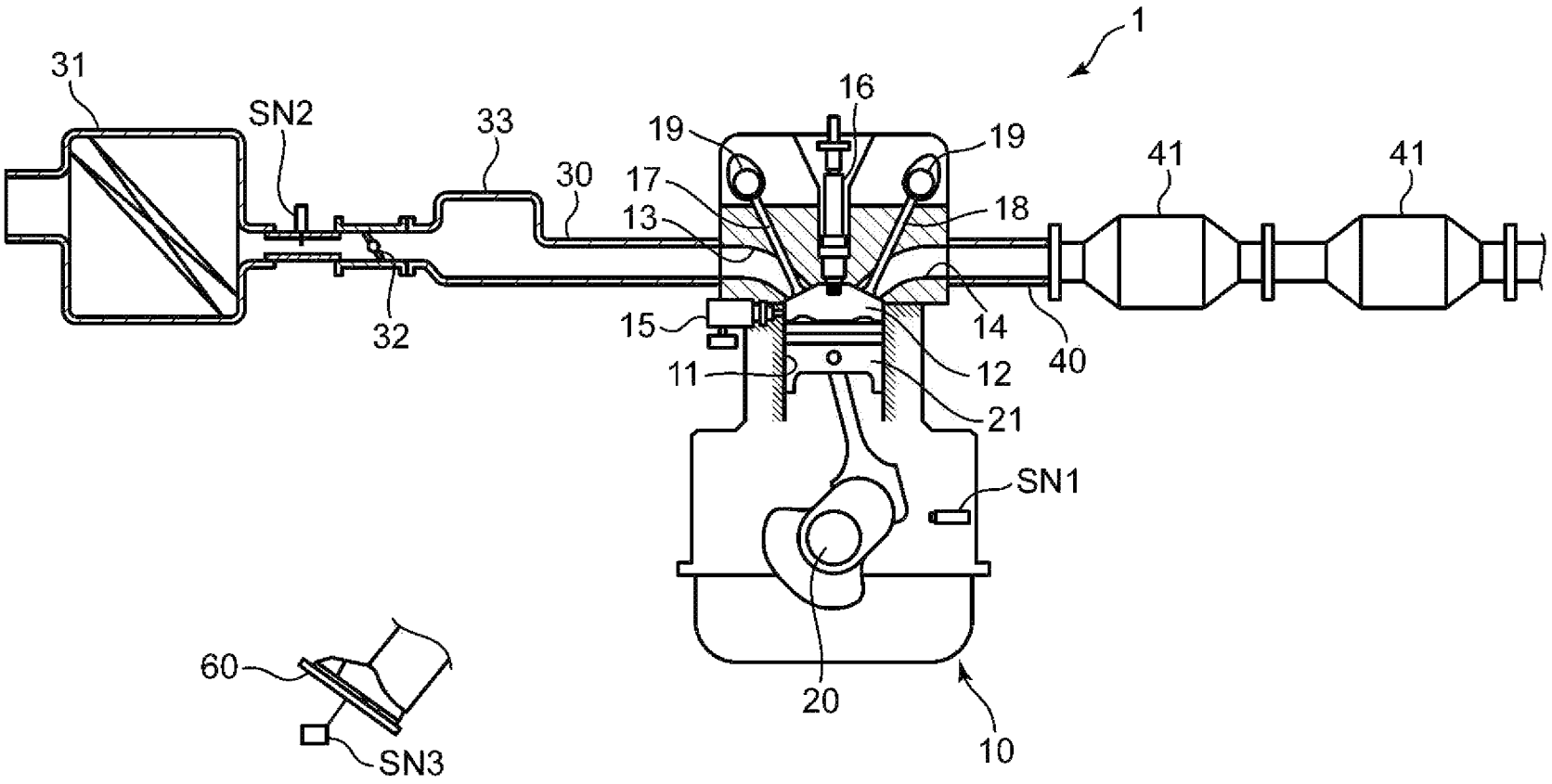
FIG. 2 is a diagram illustrating an outline configuration of an engine which is installed in the above vehicle.

FIG. 2 is a system diagram illustrating an outline configuration of the engine 1. The engine 1 is a four-cycle gasoline engine and includes an engine body 10 which combusts an air-fuel mixture of a fuel (gasoline) and air, an intake passage 30 through which air (intake air) introduced into the engine body 10 flows, and an exhaust passage 40 through which exhaust gas exhausted from the engine body 10 flows.

The engine body 10 includes a housing (a cylinder block, a cylinder head, and so forth) in an internal portion of which a plurality of cylinders 11 illustrated in FIG. 1 are formed and pistons 21 which are housed in the respective cylinders 11 to be capable of reciprocating motions. Below the piston 21, the above-described crankshaft 20 is disposed. The piston 21 and the crankshaft 20 are coupled together via a connecting rod or the like such that the crankshaft 20 rotates in response to reciprocating motions of the piston 21. In a lower portion (cylinder block) of the engine body 10, a crank angle sensor SN1 is provided which detects an angle of the crankshaft 20 (crank angle) and a rotational speed of the crankshaft 20 (engine speed).

Above the pistons 21 of the cylinders 11, respective combustion chambers 12 are demarcated. In each of the combustion chambers 12, an intake port 13 and an exhaust port 14 open. In an upper portion (cylinder head) of the engine body 10, a combination of an injector 15, a spark plug 16, an intake valve 17, and an exhaust valve 18 is provided to each of the cylinders 11. The injector 15 is an injection valve which injects the fuel (gasoline) into the combustion chamber 12. The spark plug 16 is a plug which ignites the air-fuel mixture in which the injected fuel and air are mixed together. The intake valve 17 is a valve which opens and closes the intake port 13. The exhaust valve 18 is a valve which opens and closes the exhaust port 14. In the upper portion of the engine body 10, a valve mechanism 19 is provided which drives and opens and closes the intake valves 17 and the exhaust valves 18 of the respective cylinders 11 in response to rotation of the crankshaft 20.

The intake passage 30 is connected with one side surface of the engine body 10 so as to communicate with the intake port 13 of each of the cylinders 11. The intake passage 30 is provided with an air cleaner 31 which removes foreign objects in intake air, a throttle valve 32 which adjusts a flow amount of intake air and is capable of opening and closing, and a surge tank 33 in this order from an upstream side (a far side from the engine body 10). In a section between the air cleaner 31 and the throttle valve 32 in the intake passage 30, an airflow sensor SN2 is provided which detects the flow amount of intake air.

The exhaust passage 40 is connected with another side surface of the engine body 10 so as to communicate with the exhaust port 14 of each of the cylinders 11. In the exhaust passage 40, a plurality of catalysts 41 are provided which purify harmful components in exhaust gas.

Figure 3:
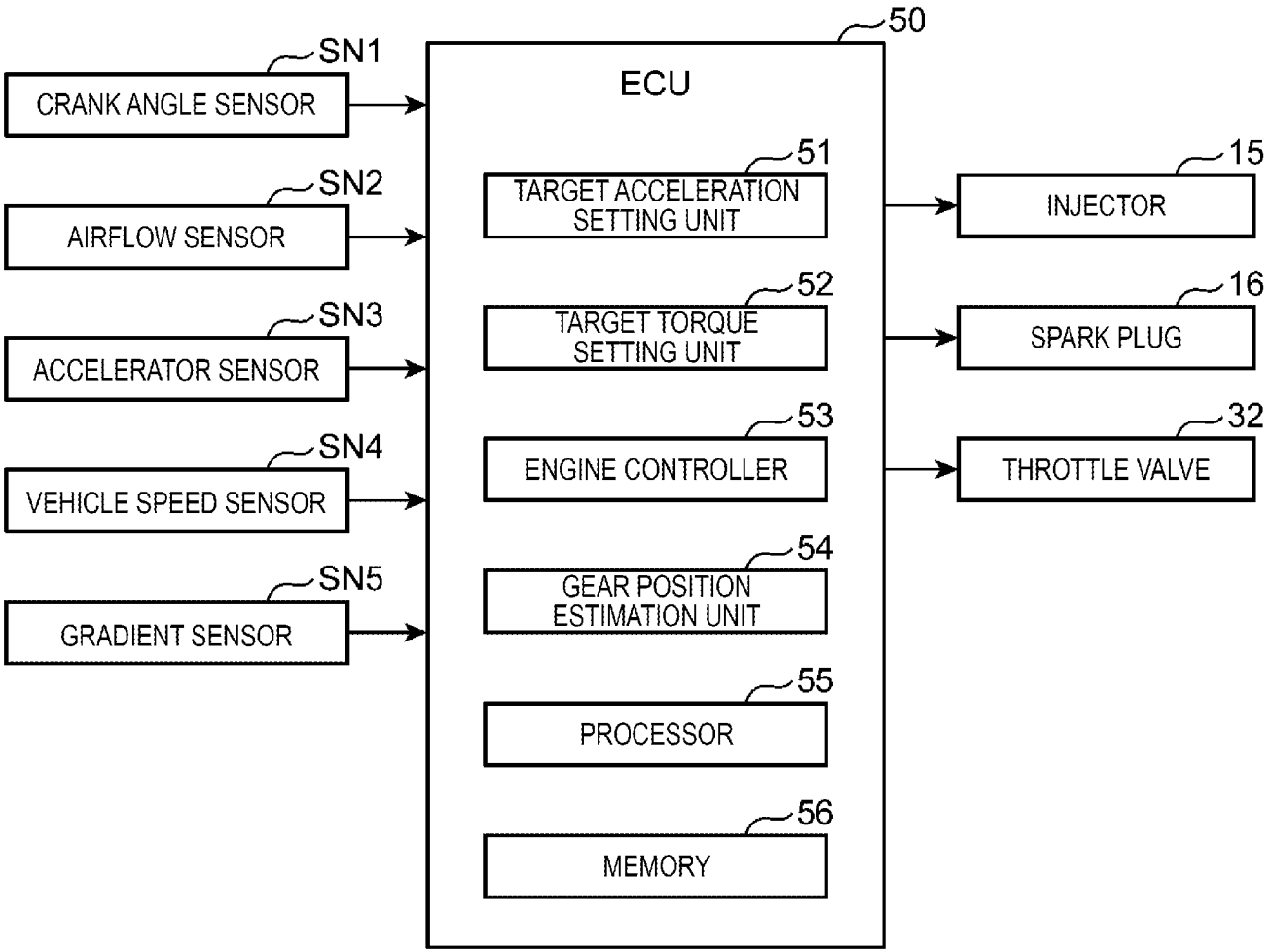
FIG. 3 is a function block diagram illustrating a control system of the above vehicle or the engine.

FIG. 3 is a function block diagram illustrating a control system of the vehicle or the engine 1. As illustrated in this FIG. 3 and above FIG. 1 and FIG. 2, the vehicle is provided with an accelerator pedal 60 which is operated by the driver driving the vehicle and an engine control unit (ECU) 50 which controls an output of the engine 1 in accordance with the operation of the accelerator pedal 60 by the driver. Further, the vehicle is provided with an accelerator sensor SN3 which detects an opening of the accelerator pedal 60 (hereinafter, referred to as accelerator opening), a vehicle speed sensor SN4 which detects a traveling speed of the vehicle (hereinafter, referred to as vehicle speed), and a gradient sensor SN5 which detects a gradient of a traveling road (hereinafter, referred to as road surface gradient) on which the vehicle travels. Note that the gradient sensor SN5 may be a sensor of a type which detects an inclination degree of the vehicle and thereby directly specifies the road surface gradient or may be a sensor of a type which detects an acceleration or the like of the vehicle and thereby indirectly specifies the road surface gradient from an estimation based on the detection results.

The ECU 50 is configured with a microcomputer which includes a processor (e.g., a central processing unit (CPU)) 55 performing computation, memory 56 such as ROM and RAM, and various kinds of input-output buses. Detection information by various kinds of sensors is input to the ECU 50. For example, the ECU 50 is electrically connected with the above-described crank angle sensor SN1, airflow sensor SN2, accelerator sensor SN3, vehicle speed sensor SN4, and gradient sensor SN5, and various kinds of information detected by those sensors, that is, each piece of information such as the crank angle, the engine speed, an intake air flow amount, the accelerator opening, the vehicle speed, and the road surface gradient is sequentially input to the ECU 50.

The ECU 50 controls actuators of the engine while executing various determinations, computation, and so forth based on input information from the above sensors (SN1 to SN5 and so forth). For example, the ECU 50 is electrically connected with plural actuators including the injectors 15, the spark plugs 16, and the throttle valves 32 and appropriately outputs control signals based on the above determinations, computation, and so forth to those actuators.

The ECU 50 comprises a target acceleration setting unit 51, a target torque setting unit 52, an engine controller 53, and a gear stage estimation unit 54 that are executed by the processor 55 to perform their respective functions. These units are stored in the memory 56 as software modules. The target acceleration setting unit 51 is a control module which sets a target acceleration of the vehicle based on various kinds of information including the accelerator opening detected by the accelerator sensor SN3. The target torque setting unit 52 is a control module which sets a target torque (a target value of a rotational torque of the crankshaft 20) of the engine 1 based on the target acceleration set by the target acceleration setting unit 51. The engine controller 53 is a control module which controls the engine 1 to generate the target torque set by the target torque setting unit 52. The gear stage estimation unit 54 is a control module which estimates the gear stage of the transmission 101 from the relationship between the vehicle speed detected by the vehicle speed sensor SN4 and the engine speed detected by the crank angle sensor SN1. Note that the engine controller 53 is an example of a "drive source controller" in the present disclosure.

(2) Basic Control

Figure 4:
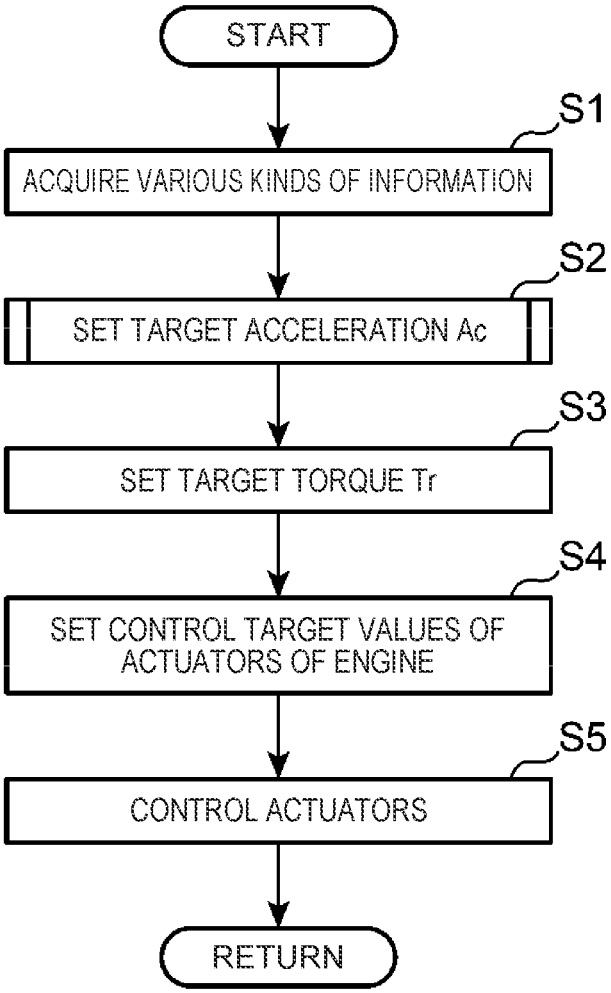
FIG. 4 is a flowchart illustrating contents of basic control which is executed during traveling of the vehicle.

Next, a description will be made about basic control executed by the ECU 50 during traveling of the vehicle with reference to the flowchart of FIG. 4. When the control illustrated in FIG. 4 is started, the ECU 50 acquires various kinds of information which indicate a present state of the vehicle or the engine 1 (step S1). For example, the ECU 50 acquires each of the crank angle and engine speed which are detected by the crank angle sensor SN1, the intake air flow amount detected by the airflow sensor SN2, the accelerator opening detected by the accelerator sensor SN3, the vehicle speed detected by the vehicle speed sensor SN4, the road surface gradient detected by the gradient sensor SN5, and the gear stage of the transmission 101 which is estimated by the gear stage estimation unit 54.

Next, the target acceleration setting unit 51 of the ECU 50 sets a target acceleration Ac of the vehicle based on information such as the accelerator opening acquired in step S1 (step S2). Details of a setting method of this target acceleration Ac will be described in a section (3) described later.

Next, the target torque setting unit 52 of the ECU 50 sets a target torque Tr as an output torque of the engine 1 which is necessary for realizing the target acceleration Ac set in step S2 (step S3). Specifically, the target torque setting unit 52 sets the target torque Tr of the engine 1 based on the target acceleration Ac set in step S2 and the vehicle speed acquired in step S1. The vehicle speed is taken into consideration for setting of the target torque Tr because a traveling resistance increases as the vehicle speed becomes higher. In other words, the target torque setting unit 52 estimates the present traveling resistance of the vehicle from information such as the vehicle speed acquired in step S1, calculates the output torque of the engine 1 which is necessary for accelerating the vehicle at the target acceleration Ac against the estimated traveling resistance, and thereby sets the calculated output torque as the above target torque Tr.

Next, the engine controller 53 of the ECU 50 sets, for the actuators of the engine 1, control target values for realizing the target torque Tr set in step S3 (step S4). For example, the engine controller 53 sets respective target values of control amounts including an injection amount and an injection timing of the injector 15, an ignition timing of the spark plug 16, and an opening of the throttle valve 32 such that a combustion force corresponding to the above target torque Tr is generated in each of the cylinders 11 of the engine 1.

Next, the engine controller 53 controls the actuators of the engine 1 in accordance with the control target values set in step S4 (step S5). For example, the engine controller 53 respectively controls the injector 15, the spark plug 16, and the throttle valve 32 such that the respective control amounts of the injector 15, the spark plug 16, and the throttle valve 32 agree with the control target values set in step S4. Accordingly, the output torque equivalent to the target torque Tr set in step S3 is generated in the engine 1. This output torque accelerates the vehicle at the acceleration equivalent to the target acceleration Ac set in step S2.

(3) Basic Flow of Target Acceleration Setting

Figure 5:
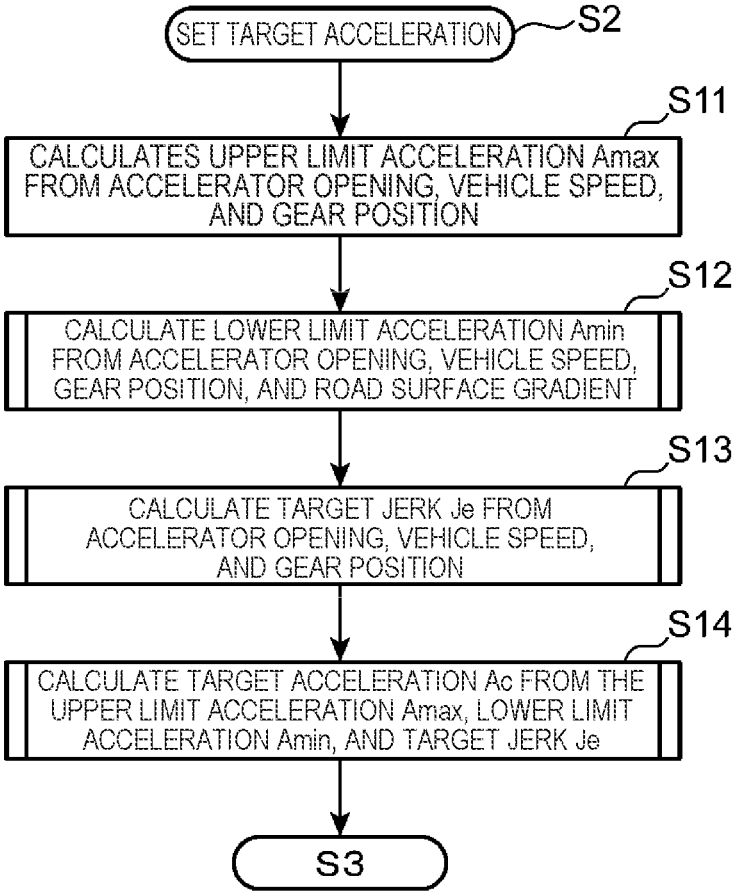
FIG. 5 represents a subroutine illustrating details of control in step S2 in FIG. 4.

Next, a detailed description will be made about control contents of step S2 for setting the target acceleration Ac of the vehicle. FIG. 5 represents a subroutine illustrating details of control in step S2. When the control illustrated in FIG. 5 is started, the target acceleration setting unit 51 of the ECU 50 calculates an upper limit acceleration Amax of the vehicle based on the accelerator opening, the vehicle speed, and the gear stage which are acquired in step S1 (FIG. 4) (step S11). The upper limit acceleration Amax is an upper limit value of the target acceleration Ac of the vehicle and is a value which can be employed when the driver performs an operation of increasing depression of the accelerator pedal 60 (of increasing the accelerator opening). Note that in the following, information such as the accelerator opening acquired in step S1 may be rephrased as the present accelerator opening or the like; however, in any case, that means the newest information acquired in a currently progressing processing routine, and its meaning is the same.

Figure 9A:
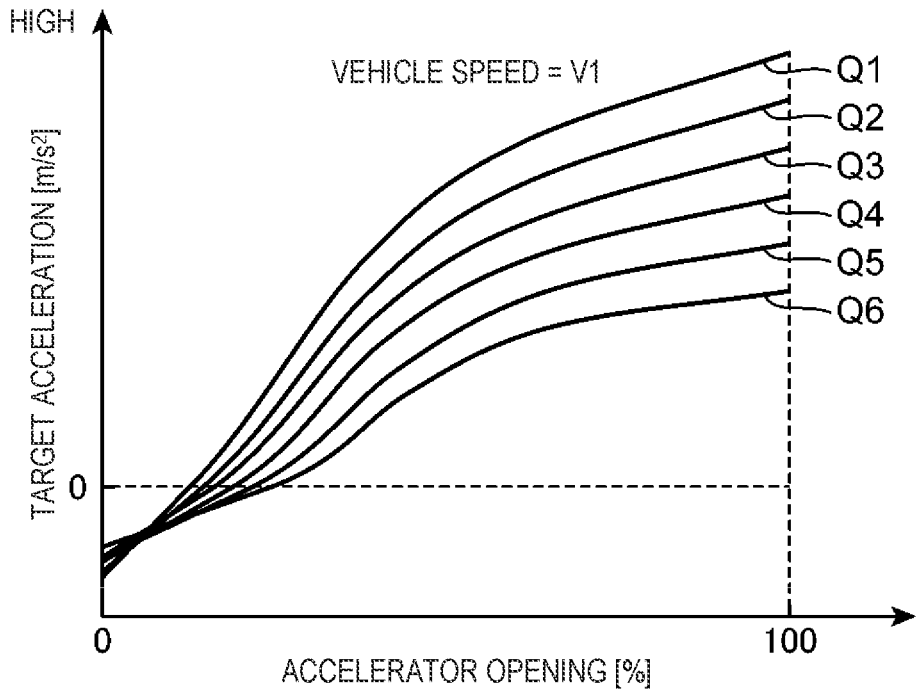
FIGS. 9A and 9B are diagrams illustrating acceleration characteristic maps which define the relationship between an accelerator opening and a target acceleration for a vehicle speed and each gear stage.
Figure 9B:
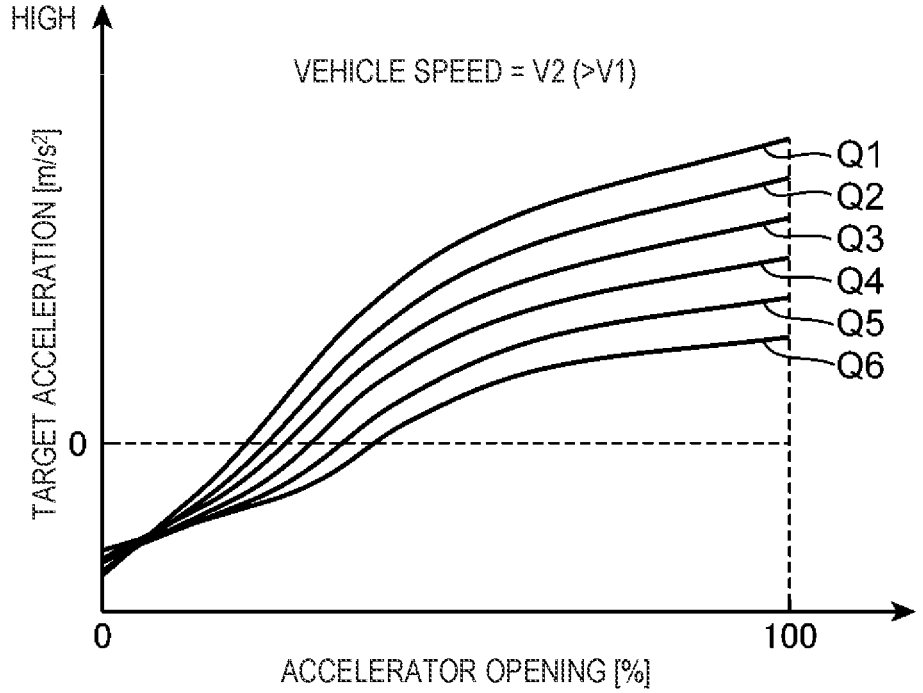

The upper limit acceleration Amax is decided in accordance with an acceleration characteristic map which defines the relationship between the accelerator opening and the target acceleration (this will hereinafter be referred to as acceleration characteristics also) for the vehicle speed and each of the gear stages. FIGS. 9A and 9B are diagrams illustrating one example of this acceleration characteristic map. FIGS. 9A and 9B illustrate, as an example, the acceleration characteristic map which is set in a case where the transmission 101 is a transmission which has six forward stages, and the graphs of FIGS. 9A and 9B illustrate maps at vehicle speeds of V1 and V2. In this example, the vehicle speed V2 is greater than the vehicle speed V1 (V2>V1). Six characteristic curves Q1 to Q6 in the graphs represent acceleration characteristics at different gear stages, and Q1, Q2, Q3, Q4, Q5, and Q6 represent the acceleration characteristics at a first speed, a second speed, a third speed, a fourth speed, a fifth speed, and a sixth speed, respectively. In other words, FIG. 9A represents the map in which the acceleration characteristics at a vehicle speed of V1 are defined for each of the gear stages (the first speed to the sixth speed), and FIG. 9B represents the map in which the acceleration characteristics at a vehicle speed of V2 (>V1) are defined for each of the gear stages. The acceleration characteristics defined in both of the maps are set such that the target acceleration becomes higher as the accelerator opening is wider and are set such that the target acceleration becomes lower as the gear stage is higher under the same condition of the accelerator opening (except a case where the accelerator opening is very narrow). Those acceleration characteristic maps are stored in advance in a storage medium in the ECU 50 together with maps for various vehicle speeds other than V1 and V2.

In step S11, the target acceleration setting unit 51 calculates the upper limit acceleration Amax by applying the accelerator opening, the vehicle speed, and the gear stage, which are acquired in step S1, to the acceleration characteristic maps illustrated in FIGS. 9A and 9B. For example, in a case where the present vehicle speed is V1 and the present gear stage is the third speed, the target acceleration setting unit 51 calculates, as the upper limit acceleration Amax, the value which is on a characteristic curve Q3 in the map of FIG. 9A and corresponds to the present accelerator opening.

Next, the target acceleration setting unit 51 calculates a lower limit acceleration Amin of the vehicle based on the accelerator opening, the vehicle speed, the gear stage, and the road surface gradient which are acquired in step S1 (step S12). The lower limit acceleration Amin is a lower limit value of the target acceleration Ac of the vehicle and is a value which can be employed when the driver performs an operation of returning the accelerator pedal 60 (of decreasing the accelerator opening). Details of a calculation method of this lower limit acceleration Amin will be described in a section (4) described later.

Next, the target acceleration setting unit 51 calculates a target jerk Je of the vehicle based on the accelerator opening, the vehicle speed, and the gear stage which are acquired in step S1 (step S13). In the present specification, a jerk denotes a change rate of an acceleration (a value of a time derivative of the acceleration), and the target jerk Je denotes a target value of the jerk. Details of a calculation method of this target jerk Je will be described in a section (5) described later.

Next, the target acceleration setting unit 51 calculates the target acceleration Ac of the vehicle based on the upper limit acceleration Amax, the lower limit acceleration Amin, and the target jerk Je which are calculated in steps S11 to S13 (step S14). Details of a calculation method of this target acceleration Ac will be described in a section (6) described later.

(4) Calculation Flow of Lower Limit Acceleration

Figure 6:
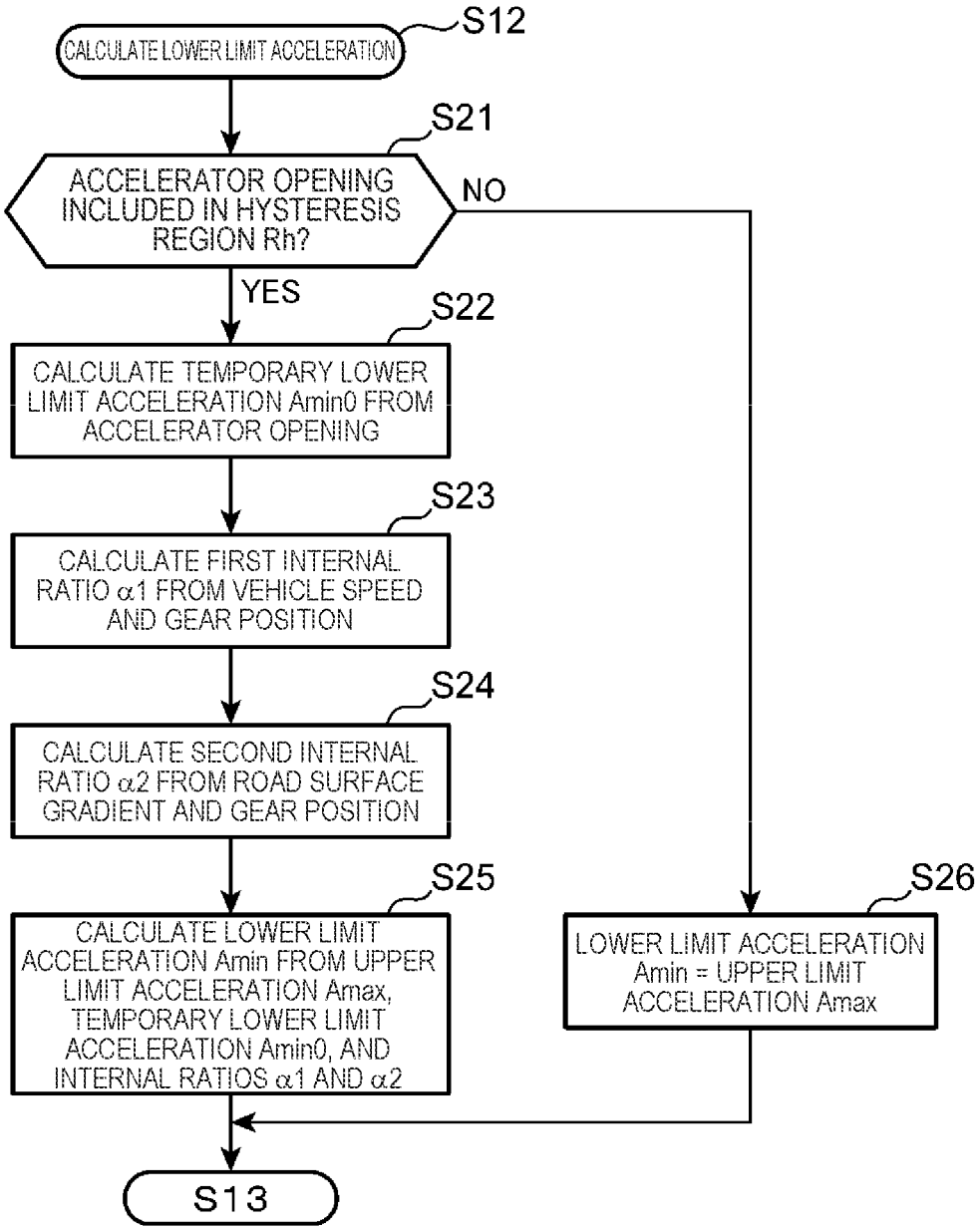
FIG. 6 represents a subroutine illustrating details of control in step S12 in FIG. 5.

Next, a detailed description will be made about control contents of step S12 for calculating the lower limit acceleration Amin of the vehicle. FIG. 6 represents a subroutine illustrating details of the control in step S12. When the control illustrated in FIG. 6 is started, the target acceleration setting unit 51 determines whether or not the accelerator opening acquired in step S1 is included in a hysteresis region Rh decided in advance (step S21). The hysteresis region Rh denotes a region where a difference is provided between the lower limit acceleration Amin and the upper limit acceleration Amax and is decided in advance for each condition of the vehicle speed and the gear stage.

Figure 10:
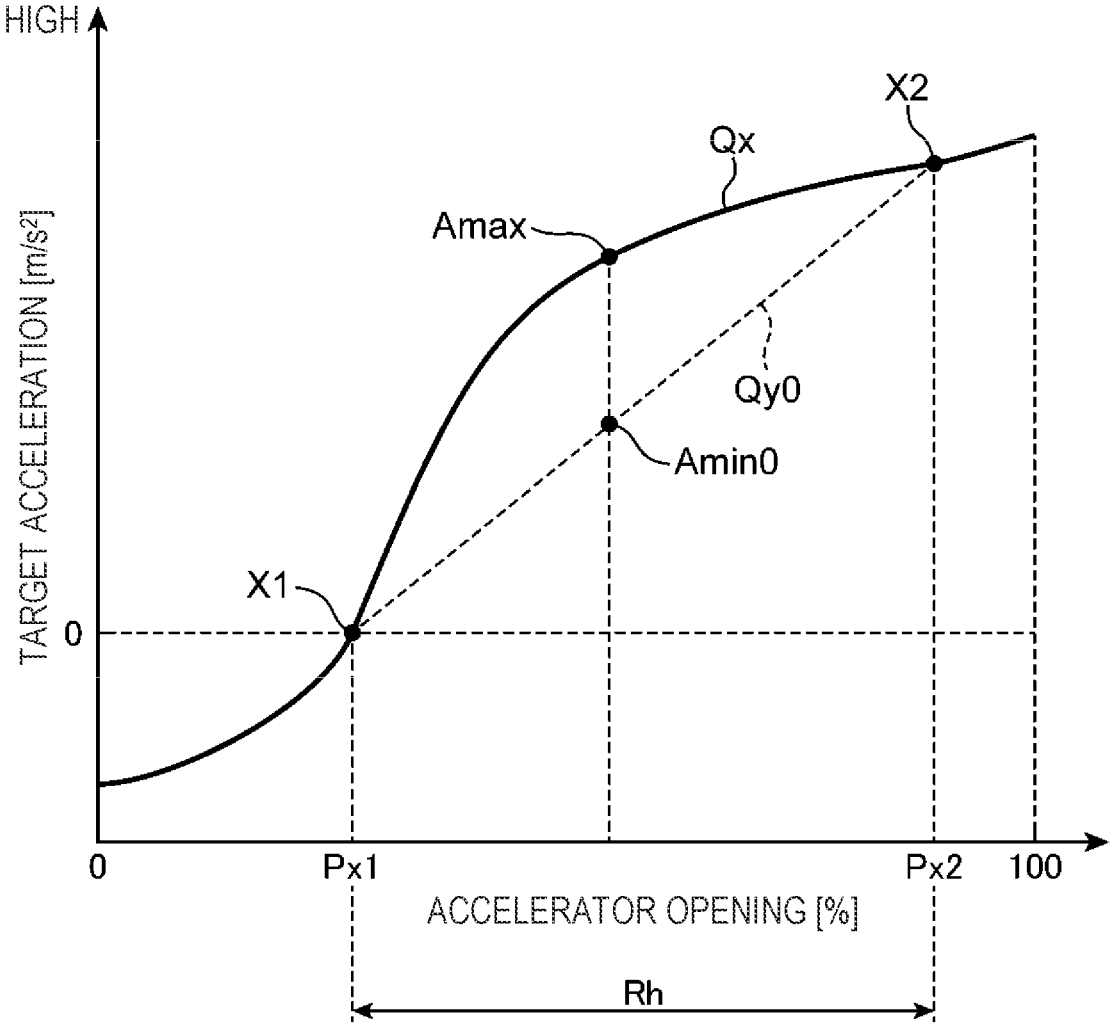
FIG. 10 is a graph illustrating the relationship between the accelerator opening and the target acceleration at specific vehicle speed and gear stage.

FIG. 10 is a graph illustrating one example of the hysteresis region Rh. A characteristic curve Qx of a solid line in this FIG. 10 represents a characteristic of the target acceleration which conforms to the present vehicle speed and gear stage and is selected from the maps of FIGS. 9A and 9B. For example, in a case where the present vehicle speed is V1 and the present gear stage is the third speed, as the characteristic curve Qx, the characteristic curve Q3 in the map of FIG. 9A is selected. As illustrated in FIG. 10, the hysteresis region Rh is a region which is positioned between two boundary points X1 and X2 on the characteristic curve Qx. In this hysteresis region Rh, the characteristic curve Qx has a characteristic in which the slope of the change in the target acceleration with respect to the change in the accelerator opening (operation gain) decreases toward a wider opening side. In other words, the hysteresis region Rh is set to contain a curved portion of the characteristic curve Qx, the curved portion being curved to draw an arc protruding upward. When between the boundary points X1 and X2 of the hysteresis region Rh, the boundary point X1 on a narrow opening side is set as a first boundary point and the boundary point X2 on a wide opening side is set as a second boundary point, the first boundary point X1 is set to a position where the target acceleration becomes about zero, and the second boundary point X2 is set to a position where the accelerator opening becomes a high opening close to the full opening (for example, around 90%). Note that in the following, the accelerator opening corresponding to the first boundary point X1 will be referred to as first opening Px1, and the accelerator opening corresponding to the second boundary point X2 will be referred to as second opening Px2.

In step S21, in a case where the target acceleration setting unit 51 compares the accelerator opening acquired in step S1 with each of the above-described first and second boundary points X1 and X2, in other words, the first opening Px1 and the second opening Px2 and where it is confirmed that the accelerator opening is wider than the first opening Px1 and narrower than the second opening Px2, the target acceleration setting unit 51 determines that the accelerator opening is included in the hysteresis region Rh.

In a case where the determination is NO in step S21 and it is confirmed that the present accelerator opening is out of the hysteresis region Rh, the target acceleration setting unit 51 sets the same value as the upper limit acceleration calculated in step S11 as the lower limit accelerator Amin (step S26). This means that the upper limit acceleration Amax calculated in step S11 (in other words, a value on the characteristic curve Qx in FIG. 10) is set as the target acceleration Ac without any change. However, because the accelerator opening is out of the hysteresis region Rh, the target acceleration Ac set here becomes a certain value on the characteristic curve Qx positioned on the outside of the hysteresis region Rh.

On the other hand, in a case where the determination is YES in step S21 and it is confirmed that the accelerator opening is included in the hysteresis region Rh, the target acceleration setting unit 51 calculates a temporary lower limit acceleration Amin0 based on the accelerator opening acquired in step S1 (step S22). Specifically, the target acceleration setting unit 51 calculates a value on a temporary lower limit line Qy0 illustrated in FIG. 10 as the temporary lower limit acceleration Amin0. The temporary lower limit line Qy0 is defined as a line which linearly connects the first boundary point X1 as a boundary of the hysteresis region Rh on a narrow opening side with the second boundary point X2 as a boundary of the hysteresis region Rh on a wide opening side. In step S22, the target acceleration setting unit 51 calculates a value on this temporary lower limit line Qy0, the value corresponding to the present accelerator opening, as the temporary lower limit acceleration Amin0.

Next, the target acceleration setting unit 51 calculates a first internal ratio $\alpha$1 which defines the relationship between the lower limit acceleration Amin to be set and the upper limit acceleration Amax and temporary lower limit acceleration Amin0 based on the vehicle speed and the gear stage which are acquired in step S1 (step S23). That is, the lower limit acceleration Amin is variably set between the upper limit acceleration Amax and the temporary lower limit acceleration Amin0. Accordingly, in step S23, in order to decide how close to the upper limit acceleration Amax or the temporary lower limit acceleration Amin0 the value to be set as the lower limit acceleration Amin is, the first internal ratio $\alpha$1 based on the vehicle speed and the gear stage is calculated.

The first internal ratio $\alpha$1 is variably set between zero and one. Specifically, the first internal ratio $\alpha$1 is set to zero in a case where the lower limit acceleration Amin agrees with the upper limit acceleration Amax but is set to one in a case where the lower limit acceleration Amin agrees with the temporary lower limit acceleration Amin0. Further, the first internal ratio $\alpha$1 is set to an intermediate value between zero and one in a case where the lower limit acceleration Amin is lower than the upper limit acceleration Amax and higher than the temporary lower limit acceleration Amin0. In other words, the lower limit acceleration Amin is set to a value closer to the upper limit acceleration Amax (farther from the temporary lower limit acceleration Amin0) as the first internal ratio $\alpha$1 is closer to zero, and the lower limit acceleration Amin is set to a value closer to the temporary lower limit acceleration Amin0 (farther from the upper limit acceleration Amax) as the first internal ratio $\alpha$1 is closer to one.

Next, the target acceleration setting unit 51 calculates a second internal ratio $\alpha$2 based on the road surface gradient and the gear stage which are acquired in step S1 (step S24). Similarly to the above-described first internal ratio $\alpha$1, the second internal ratio $\alpha$2 is a value which defines the relationship between the lower limit acceleration Amin to be set and the upper limit acceleration Amax and temporary lower limit acceleration Amin0 and is variably set between zero and one. The lower limit acceleration Amin is set to a value closer to the upper limit acceleration Amax (farther from the temporary lower limit acceleration Amin0) as the second internal ratio $\alpha$2 is closer to zero, and the lower limit acceleration Amin is set to a value closer to the temporary lower limit acceleration Amin0 (farther from the upper limit acceleration Amax) as the second internal ratio $\alpha$2 is closer to one. However, parameters which define the second internal ratio $\alpha$2 are the road surface gradient and the gear stage, and in this meaning, the second internal ratio $\alpha$2 is different from the first internal ratio $\alpha$1 defined based on the vehicle speed and the gear stage.

Figure 11:
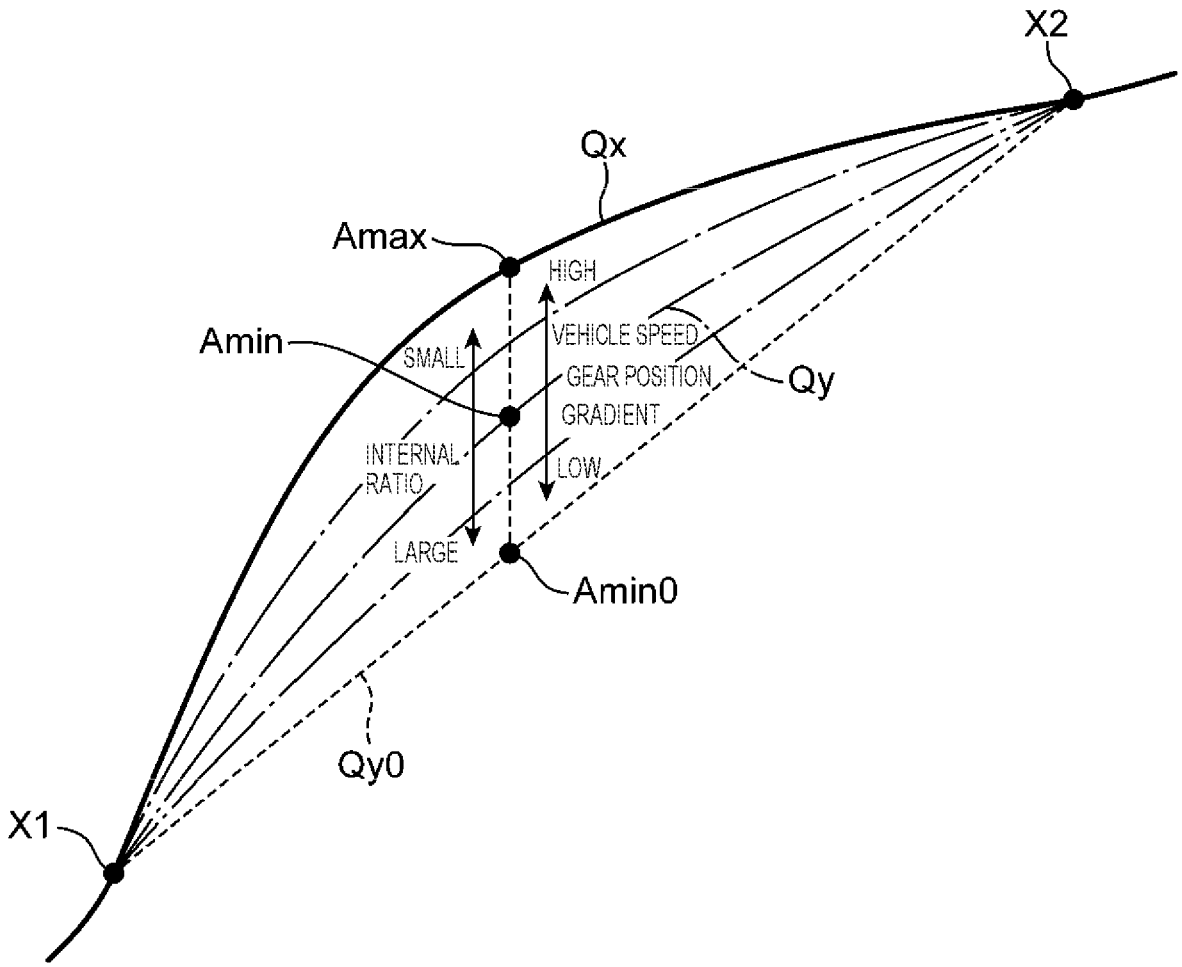
FIG. 11 is a diagram for explaining a setting method of a lower limit acceleration in accordance with a vehicle speed, a gear stage, and a road surface gradient.

As illustrated in FIG. 11, the first internal ratio $\alpha$1 and the second internal ratio $\alpha$2 which are set in steps S23 and S24 are set to become lower as any of the vehicle speed, the gear stage, and the road surface gradient is greater. This means that the lower limit acceleration Amin is set to a value closer to the upper limit acceleration Amax as the vehicle speed becomes higher, the lower limit acceleration Amin is set to a value closer to the upper limit acceleration Amax as the gear stage becomes higher, and the lower limit acceleration Amin is set to a value closer to the upper limit acceleration Amax as the road surface gradient becomes larger. Note that "the road surface gradient becomes large" here is based on the assumption that a gradient of a hill-climbing road is dealt with as a positive gradient. In other words, the road surface gradient being large means that a traveling road of the vehicle is a comparatively steep (hill-climbing) road.

Next, the target acceleration setting unit 51 calculates the lower limit acceleration Amin of the vehicle based on the upper limit acceleration Amax calculated in step S11, the temporary lower limit acceleration Amin0 calculated in step S22, and the first internal ratio $\alpha$1 and the second internal ratio $\alpha$2 which are calculated in steps S23 to S24 (step S25). Specifically, the target acceleration setting unit 51 calculates the lower limit acceleration Amin by using the following formula (1).

$$Amin=Amax-\min[\alpha 1,\max\{(Amax-Ac')/(Amax-Amin0),\alpha 2\}]\times(Amax-Amin0) \quad (1)$$

Here, Ac' denotes the previous target acceleration, in other words, a target acceleration calculated in the most recent processing routine which has already been completed.

In the above formula (1), in principle, the lower limit acceleration Amin is calculated based on the upper limit acceleration Amax, the temporary lower limit acceleration Amin0, and the lesser of the first internal ratio $\alpha$1 and the second internal ratio $\alpha$2. That is, the value resulting from multiplication of the difference between the upper limit acceleration Amax and the temporary lower limit acceleration Amin0 (Amax−Amin0) by the lesser of the first internal ratio $\alpha$1 and the second internal ratio $\alpha$2 is subtracted from the upper limit acceleration Amax, and the lower limit acceleration Amin is thereby calculated. However, in a case where the ratio (Amax−Ac')/(Amax−Amin0) obtained by dividing the difference between the upper limit acceleration Amax and the previous target acceleration Ac (Amax−Ac') by the difference between the upper limit acceleration Amax and the temporary lower limit acceleration Amin0 (Amax−Amin0) is greater than the second internal ratio $\alpha$ and is smaller than the first internal ratio $\alpha$1, the above ratio is used instead of the above internal ratios $\alpha$1 and $\alpha$2.

Figure 12:
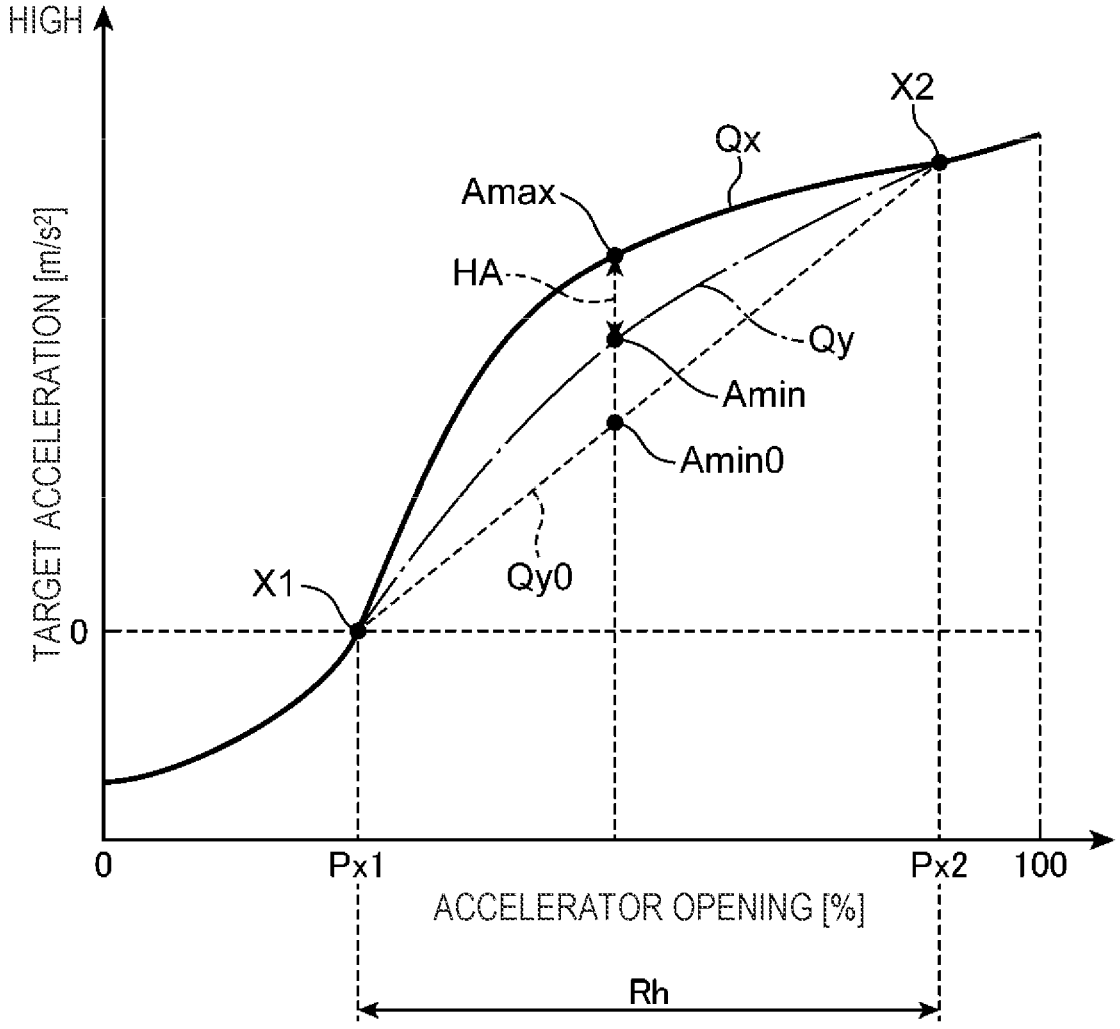
FIG. 12 is a diagram corresponding to FIG. 10, which illustrates one example of the set lower limit acceleration.

FIG. 12 is a diagram illustrating one example of the lower limit acceleration Amin calculated in step S25. In the example illustrated in FIG. 12, the lower limit acceleration Amin is set on a lower limit curve Qy which is positioned between the characteristic curve Qx defining the upper limit acceleration Amax and the temporary lower limit line Qy0 defining the temporary lower limit acceleration Amin0. The lower limit curve Qy is a curve which splits a portion between the characteristic curve Qx and the temporary lower limit line Qy0 at specific ratios, and a value which is on this lower limit curve Qy and corresponds to the present accelerator opening is calculated as the above lower limit acceleration Amin.

As illustrated in FIG. 12, when the difference between the upper limit acceleration Amax and the lower limit acceleration Amin is set as an upper-lower limit difference HA, this upper-lower limit difference HA decreases toward a position closer to the boundary (the first boundary point X1 or the second boundary point X2) of the hysteresis region Rh and increases toward a position closer to a center side of the hysteresis region Rh. In other words, the upper-lower limit difference HA is set such that it becomes zero when the accelerator opening is a boundary opening of the hysteresis region Rh, in other words, the first opening Px1 or the second opening Px2 and is enlarged as the accelerator opening becomes closer to an intermediate value between the first opening Px1 and the second opening Px2. In step S25, the target acceleration setting unit 51 sets the lower limit acceleration Amin such that the upper-lower limit difference HA changes in such a tendency.

(5) Calculation Flow of Target Jerk

Figure 7:
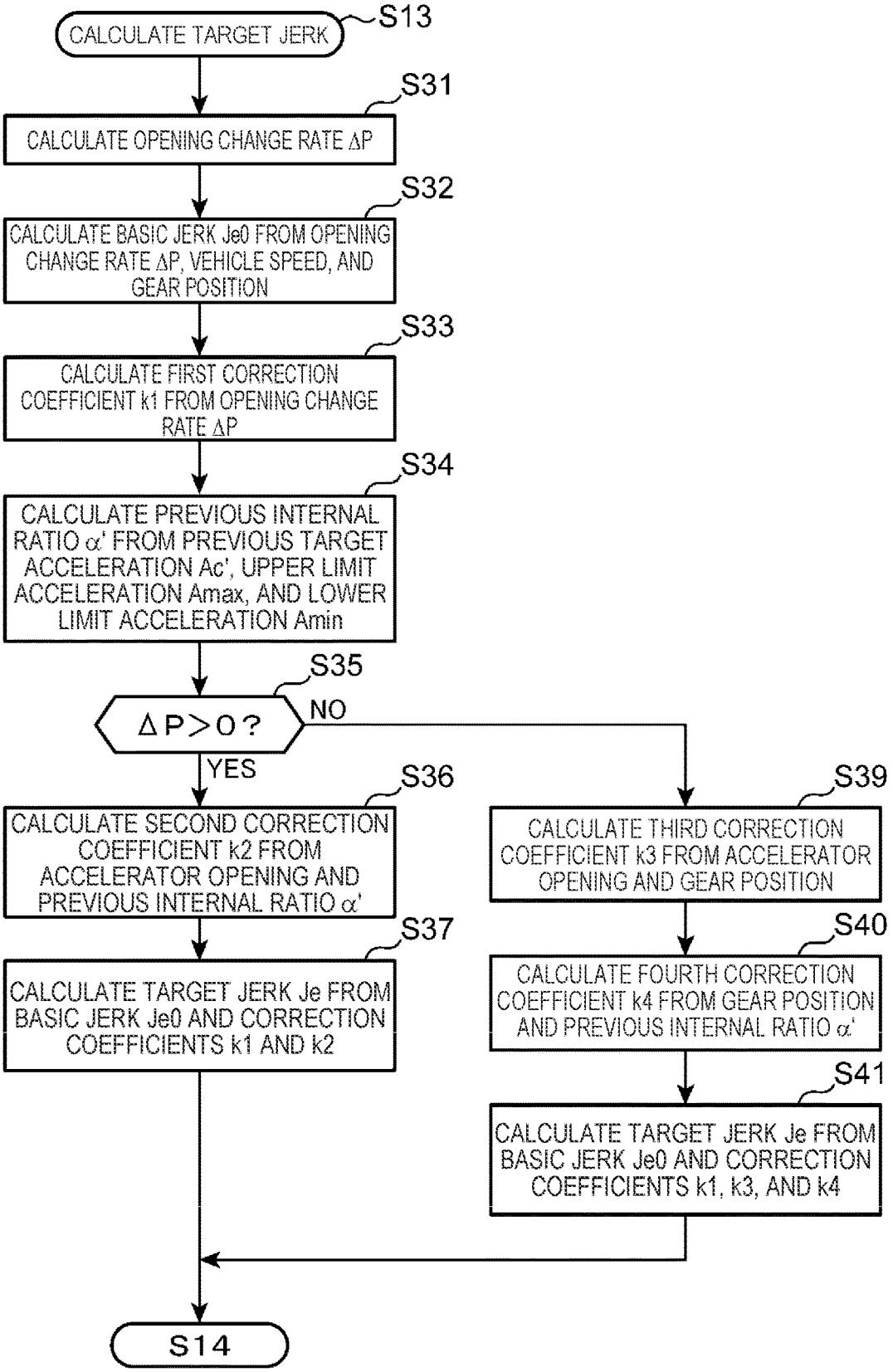
FIG. 7 represents a subroutine illustrating details of control in step S13 in FIG. 5.

Next, a detailed description will be made about control contents of step S13 for calculating the target jerk Je of the vehicle. FIG. 7 represents a subroutine illustrating details of control in step S13. When the control illustrated in FIG. 7 is started, the target acceleration setting unit 51 calculates an opening change rate ΔP as a change rate of the accelerator opening (step S31). The opening change rate ΔP is a value of a time derivative of the accelerator opening and is calculated from a history of the accelerator opening, which is acquired through the most recent predetermined period, for example. In this case, the target acceleration setting unit 51 calculates the opening change rate ΔP based on the change in data of plural accelerator openings including the accelerator opening acquired in a currently progressing processing routine (step S1) and the accelerator openings acquired in the most recent processing routine which has already been completed. The opening change rate ΔP is calculated as a positive value when depression of the accelerator pedal 60 is increased and is calculated as a negative value when the accelerator pedal 60 is returned. Note that in the following, the opening change rate ΔP will appropriately be referred to as accelerator opening change rate ΔP.

Next, the target acceleration setting unit 51 calculates a basic jerk Je0 based on the accelerator opening change rate ΔP calculated in step S31 and the vehicle speed and the gear stage which are acquired in step S1 (step S32). Specifically, the target acceleration setting unit 51 multiplies the accelerator opening change rate ΔP by a coefficient obtained from the vehicle speed and the gear stage based on a map or the like which is decided in advance and thereby calculates the basic jerk Je0. Note that the coefficient used here (the coefficient by which the accelerator opening change rate ΔP is multiplied) can appropriately be decided in accordance with the vehicle speed and the gear stage but is set to become small as the gear stage is higher, for example.

Figure 13:
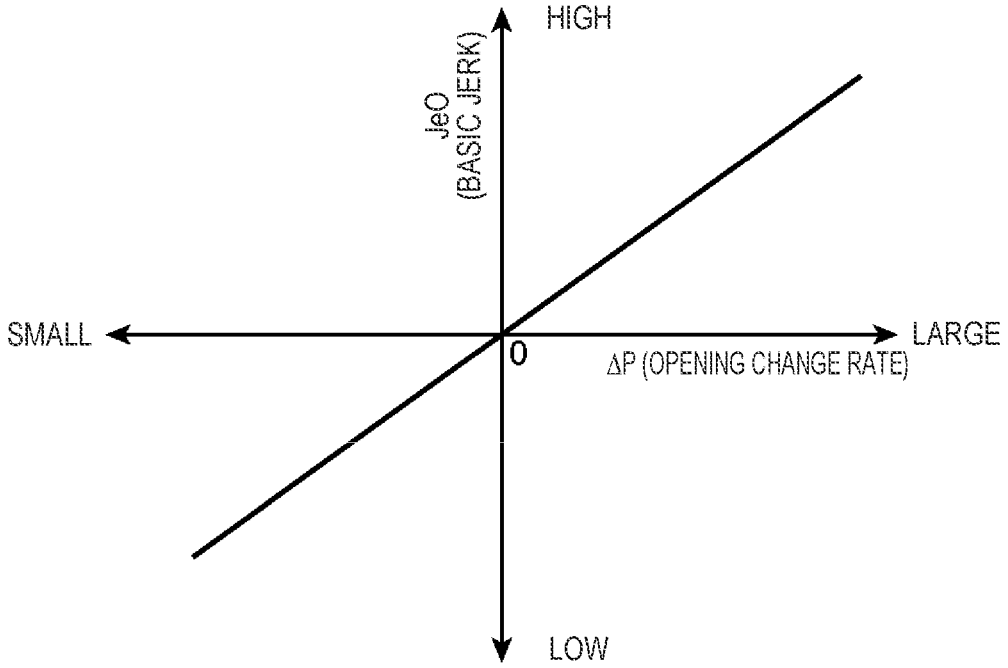
FIG. 13 is a graph illustrating the relationship between an accelerator opening change rate and a basic jerk.

FIG. 13 is a graph illustrating the relationship between the accelerator opening change rate ΔP and the basic jerk Je0. As described above, because the value obtained by multiplying the accelerator opening change rate ΔP by the coefficient decided from the vehicle speed and the gear stage is the basic jerk Je0, this basic jerk Je0 changes proportionally to the accelerator opening change rate ΔP under a condition where the vehicle speed and the gear stage are the same. That is, the basic jerk Je0 is calculated such that it takes a positive value when depression of the accelerator pedal 60 is increased (when AP is positive) and increases to the positive side as a depression-increasing speed is faster. Conversely, the basic jerk Je0 is calculated such that it takes a negative value when the accelerator pedal 60 is returned (when AP is negative) and increases to the negative side as a returning speed is faster.

Figure 14:
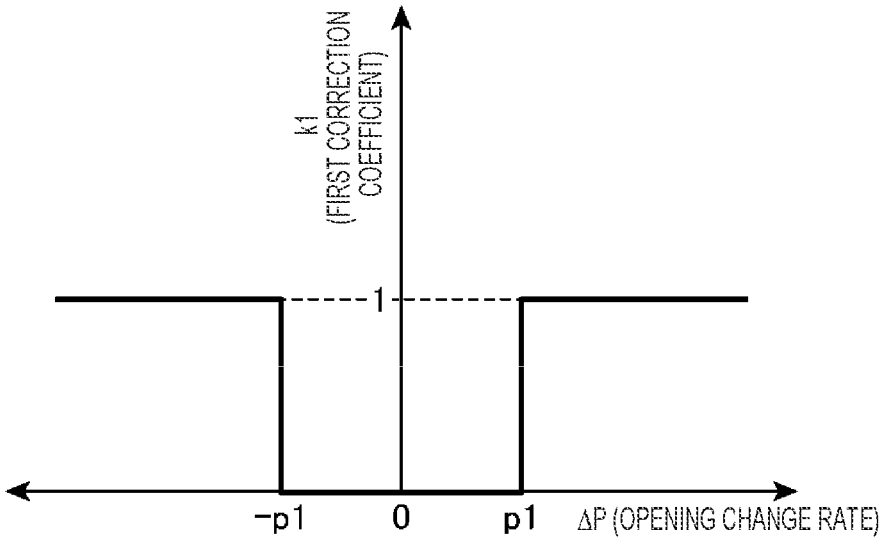
FIG. 14 is a graph illustrating a first correction coefficient which is used for calculation of a target jerk in the relationship with the accelerator opening change rate.

Next, the target acceleration setting unit 51 calculates a first correction coefficient k1 based on the accelerator opening change rate ΔP calculated in step S31 (step S33). For example, a map illustrated in FIG. 14 is applied to calculation of this correction coefficient k1. Accordingly, the first correction coefficient k1 is set to zero when the accelerator opening change rate ΔP is −p1 or more and +p1 or less and is set to one when the accelerator opening change rate ΔP is less than −p1 or more than +p1. Note that p1 (absolute value) is set to a comparatively small value. This is for preventing the change in the target acceleration from occurring even in a case where the accelerator opening unintentionally and minutely fluctuates due to vibration or the like of the vehicle.

Next, the target acceleration setting unit 51 calculates a previous internal ratio $\alpha'$ based on the previous target acceleration Ac', the upper limit acceleration Amax calculated in step S11, and the lower limit acceleration Amin calculated in step S12 (step S34). The previous internal ratio α' is a value which defines the relationship between the previous target acceleration Ac' as the target acceleration calculated in the most recent processing routine which has already been completed and the upper limit acceleration Amax and lower limit acceleration Amin and is variably set between zero and one. The previous internal ratio α' is set to a value closer to zero as the previous target acceleration Ac' is closer to the upper limit acceleration Amax (farther from the lower limit acceleration Amin), and the previous internal ratio α' is set to a value closer to one as the previous target acceleration Ac' is closer to the lower limit acceleration Amin (farther from the upper limit acceleration Amax).

Next, the target acceleration setting unit 51 determines whether or not the accelerator opening change rate ΔP calculated in step S31 is higher than zero (step S35). The accelerator opening change rate ΔP being higher than zero means that the accelerator opening is increasing, in other words, depression of the accelerator pedal 60 is being increased. Conversely, the accelerator opening change rate ΔP being lower than zero means that the accelerator opening is decreasing, in other words, the accelerator pedal 60 is being returned.

In a case where the determination is YES in step S35 and it is confirmed that the accelerator opening is increasing (depression of the accelerator pedal 60 is being increased), the target acceleration setting unit 51 calculates a second correction coefficient k2 based on the accelerator opening acquired in step S1 and the previous internal ratio cc' calculated in step S34 (step S36). For example, the target acceleration setting unit 51 applies the present accelerator opening and the previous internal ratio α' to a map decided in advance and thereby calculates the second correction coefficient k2. The second correction coefficient k2 is set to decrease as the accelerator opening becomes wider and to decrease as the previous internal ratio α' becomes lower.

Next, the target acceleration setting unit 51 calculates the target jerk Je of the vehicle based on the basic jerk Je0 calculated in step S32, the first correction coefficient k1 calculated in step S33, and the second correction coefficient k2 calculated in step S36 (step S37). Specifically, the target acceleration setting unit 51 calculates the target jerk Je by using the following formula (2).

$$Je=Je0\times k1\times k2 \quad (2)$$

Here, because the accelerator opening change rate ΔP is positive (YES in step S35) as the assumption for reaching the step S37, the basic jerk Je0 in the above formula (2) is positive. Further, as described above, the second correction coefficient k2 is a coefficient which decreases as the previous internal ratio α' becomes lower. Consequently, by computation of the above formula (2), the target jerk Je is calculated, in a range greater than zero, so as to decrease as the previous internal ratio α' becomes lower. This means that the target jerk Je decreases (becomes closer to zero) as the previous target acceleration Ac' becomes closer to the upper limit acceleration Amax.

Next, a description will be made about control in a case where the determination is NO in step S35, in other words, in a case where it is confirmed that the accelerator opening is decreasing (the accelerator pedal 60 is returned) or the acceleration opening is retained at a constant opening. In this case, the target acceleration setting unit 51 calculates a third correction coefficient k3 based on the accelerator opening and the gear stage which are acquired in step S1 (step S39). For example, the target acceleration setting unit 51 applies the present accelerator opening and gear stage to a map decided in advance and thereby calculates the third correction coefficient k3. The third correction coefficient k3 is set to decrease as the accelerator opening becomes wider and to decrease as the gear stage becomes higher.

Next, the target acceleration setting unit 51 calculates a fourth correction coefficient k4 based on the gear stage acquired in step S1 and the previous internal ratio cc' calculated in step S34 (step S40). For example, the target acceleration setting unit 51 applies the present gear stage and the previous internal ratio α' to a map decided in advance and thereby calculates the fourth correction coefficient k4. The fourth correction coefficient k4 is set to become smaller as the gear stage is higher and to become smaller as the previous internal ratio α' is higher.

Next, the target acceleration setting unit 51 calculates the target jerk Je of the vehicle based on the basic jerk Je0 calculated in step S32, the first correction coefficient k1 calculated in step S33, the third correction coefficient k3 calculated in step S39, and the fourth correction coefficient k4 calculated in step S40 (step S41). Specifically, the target acceleration setting unit 51 calculates the target jerk Je by using the following formula (3).

$$Je=Je0\times k1\times k3\times k4 \quad (3)$$

Here, because the accelerator opening change rate ΔP is zero or negative (NO in step S35) as the assumption for reaching the step S41, the basic jerk Je0 in the above formula (3) is zero or negative. Further, as described above, the fourth correction coefficient k4 is a coefficient which decreases as the previous internal ratio α' becomes higher. Consequently, by computation of the above formula (3), the target jerk Je is calculated, in a range of zero or smaller, such that its absolute value decreases as the previous internal ratio α' becomes higher. This means that the absolute value of the target jerk Je decreases (becomes closer to zero) as the previous target acceleration Ac' is closer to the lower limit acceleration Amin.

(6) Calculation Flow of Target Acceleration

Figure 8:
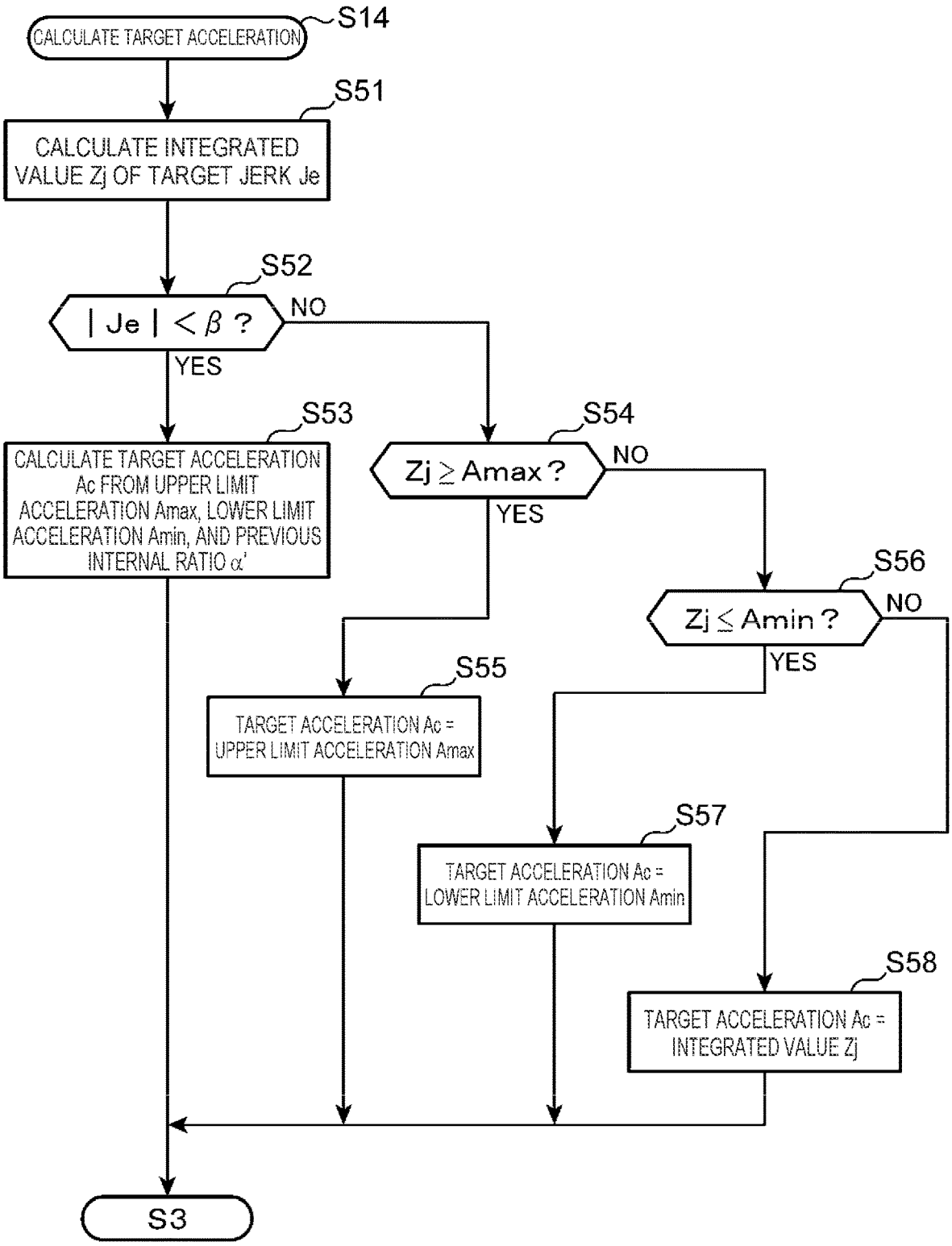
FIG. 8 represents a subroutine illustrating details of control in step S14 in FIG. 5.

Next, a detailed description will be made about control contents of step S14 for calculating the target acceleration Ac of the vehicle. FIG. 8 represents a subroutine illustrating details of control in step S14. When the control illustrated in FIG. 8 is started, the target acceleration setting unit 51 calculates an integrated value Zj resulting from integration of the target jerk Je (step S51). The integrated value Zj is calculated by adding up the target jerks Je calculated through the most recent predetermined period, for example. In this case, the target acceleration setting unit 51 adds up data of a plurality of target jerks Je including the target jerk Je calculated in a currently progressing processing routine (step S13) and the target jerks Je calculated in the most recent processing routine which has already been completed and thereby calculates the integrated value Zj.

Next, the target acceleration setting unit 51 determines whether or not the absolute value of the (present) target jerk Je calculated in step S13 is less than a predetermined threshold value β, in other words, whether or not the relationship of $-\beta<Je<\beta$ holds (step S52).

In a case where the determination is YES in step S52 and it is confirmed that the absolute value of the target jerk Je is less than the threshold value β, the target acceleration setting unit 51 calculates the target acceleration Ac based on the upper limit acceleration Amax calculated in step S11, the lower limit acceleration Amin calculated in step S12, and the previous internal ratio α' calculated in step S34 (step S53).

Specifically, the target acceleration setting unit 51 calculates the target acceleration Ac by using the following formula (4).

$$Ac=Amax-\alpha'\times(Amax-Amin) \quad (4)$$

As in the above formula (4), in step S53, the target acceleration Ac is calculated by using the internal ratio which is the same as the previous internal ratio. That is, in a case where step S53 is executed, the target acceleration Ac is retained at a value which splits a portion between the upper limit acceleration Amax and the lower limit acceleration Amin at the same ratios.

On the other hand, in a case where the determination is YES in step S52 and it is confirmed that the absolute value of the target jerk Je is the threshold value β or greater, the target acceleration setting unit 51 determines whether or not the integrated value Zj of the target jerk Je which is calculated in step S51 is the upper limit acceleration Amax calculated in step S11 or greater (step S54).

In a case where the determination is YES in step S54 and it is confirmed that the integrated value Zj of the target jerk Je is the upper limit acceleration Amax or greater, the target acceleration setting unit 51 sets the upper limit acceleration Amax calculated in step S11 as the target acceleration Ac (step S55).

On the other hand, in a case where the determination is NO in step S54 and it is confirmed that the integrated value Zj of the target jerk Je is less than the upper limit acceleration Amax, the target acceleration setting unit 51 determines whether or not the integrated value Zj of the target jerk Je which is calculated in step S51 is the lower limit acceleration Amin calculated in step S12 or less (step S56).

In a case where the determination is YES in step S56 and it is confirmed that the integrated value Zj of the target jerk Je is the lower limit acceleration Amin or less, the target acceleration setting unit 51 sets the lower limit acceleration Amin calculated in step S12 as the target acceleration Ac (step S57).

On the other hand, in a case where the determination is NO in step S56 and it is confirmed that the integrated value Zj of the target jerk Je is greater than the lower limit acceleration Amin, in other words, in a case where the relationship of Amin<Zj<Amax holds, the target acceleration setting unit 51 sets the integrated value Zj of the target jerk Je, which is calculated in step S51, as the target acceleration Ac (step S58).

(7) Operations and Effects

As described above, in the present embodiment, the target jerk Je as a target value of a jerk (a change rate of acceleration) of the vehicle is each time calculated from the accelerator opening change rate ΔP, and the target acceleration Ac of the vehicle is set based on the integrated value Zj as a value resulting from integration of the target jerk Je. Thus, in an opening range where the operation gain (the slope of the change in the acceleration with respect to the change in the accelerator opening) of the accelerator pedal 60 decreases toward a wider opening side, in other words, the hysteresis region Rh, the target acceleration Ac at a time when the accelerator pedal 60 is returned (hereinafter, also referred to as pedal-returning target acceleration) can be made lower than the target acceleration Ac at a time when depression of the accelerator pedal 60 is increased (hereinafter, also referred to as depression-increasing target acceleration).

That is, the target jerk Je set in accordance with the accelerator opening change rate ΔP (to be proportional to ΔP) becomes less in a pedal-returning situation in which the accelerator opening decreases (ΔP becomes negative) than a depression-increasing situation in which the accelerator opening increases (ΔP becomes positive). Consequently, the integrated value Zj resulting from integration of such a target jerk Je becomes less in the pedal-returning situation than the depression-increasing situation under the same condition of the accelerator opening. This means that the target acceleration Ac calculated based on the integrated value Zj becomes relatively small when the accelerator pedal 60 is returned. Accordingly, in the hysteresis region Rh where the operation gain decreases toward a wider opening side, it becomes easy to cause the driver to perceive the change in the acceleration of the vehicle at a time when the accelerator pedal 60 is returned.

For example, because the target acceleration is set such that the operation gain corresponding to the slope of the characteristic curve Qx decreases toward on a wider opening side in the above-described hysteresis region Rh, in a case where the target acceleration is evenly set along the characteristic curve Qx, the driver might feel discomfort particularly when the accelerator pedal 60 is returned. For example, in a circumstance where the driver increases depression of the accelerator pedal 60 in the hysteresis region Rh, even when the operation gain lowers in a wide opening range along the above characteristic curve Qx, such lowering of the operation gain does not lead to particular discomfort for the driver who feels an output limit of the engine. However, in a case where the target acceleration is changed along the same characteristic curve Qx when the accelerator pedal is subsequently returned, the driver might feel discomfort due to the above-described lowering of the operation gain. That is, the possibility becomes high that although the accelerator pedal 60 is returned, the change (lowering) in the acceleration is maintained at such a low level that the driver has difficulty in perceiving the change. This might cause the driver to feel discomfort (for example, a sense that the vehicle spontaneously accelerates). On the other hand, in the present embodiment, in the hysteresis region Rh, the pedal-returning target acceleration is made less than the depression-increasing target acceleration. Thus, it becomes easy to cause the driver to perceive the change in the acceleration of the vehicle (behavior change) at a time when the accelerator pedal 60 is returned, and operability of the vehicle by the accelerator pedal 60 can be improved.

Further, in the present embodiment, the upper limit acceleration Amax and the lower limit acceleration Amin are set based on a plurality of pieces of information including the accelerator opening (the accelerator opening, the vehicle speed, the gear stage, and the road surface gradient), and only in a case where the above-described integrated value Zj of the target jerk Je falls between those upper and lower limit accelerations Amax and Amin, the integrated value Zj is employed as the target acceleration Ac. In other words, in a case where the integrated value Zj is the upper limit acceleration Amax or more, the upper limit acceleration Amax is employed as the target acceleration Ac, and in a case where the integrated value Zj is the lower limit acceleration Amin or less, the lower limit acceleration Amin is employed as the target acceleration Ac. In such a configuration, because the difference between the depression-increasing target acceleration and the pedal-returning target acceleration is adequately restricted, the accelerator opening to obtain the same acceleration can be prevented from being largely different between the depression-increasing situation and the pedal-returning situation. Accordingly, while adequate responsiveness (a sense that the acceleration adequately changes) is given to the driver when depression of the accelerator pedal 60 is increased and when the accelerator pedal 60 is returned, discomfort given to the driver due to differences in acceleration characteristics between the depression-increasing situation and the pedal-returning situation can be reduced.

Figure 15:
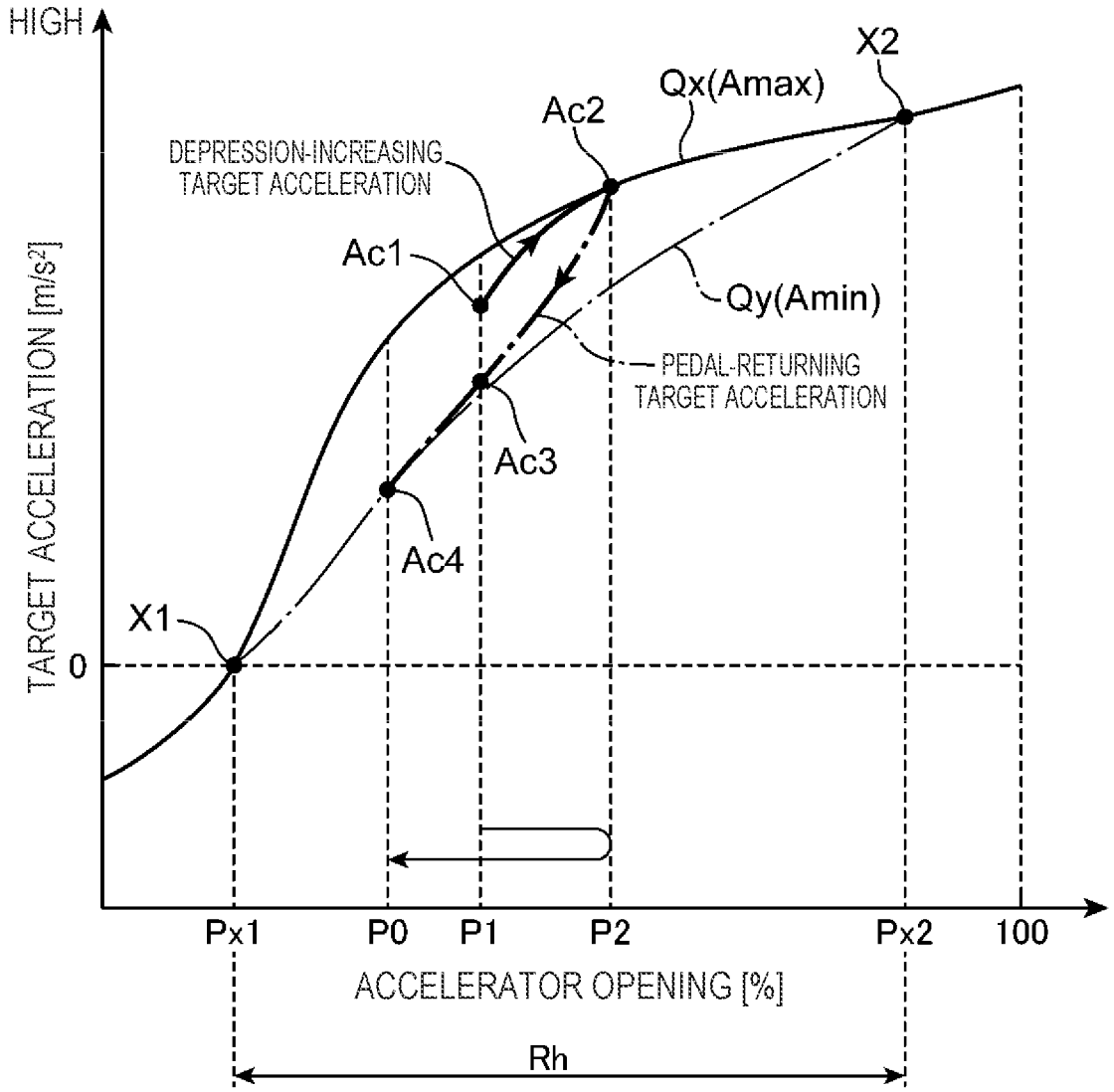
FIG. 15 is a diagram illustrating a change in the target acceleration in a case where a driver once increases depression of an accelerator pedal and thereafter returns the accelerator pedal.

FIG. 15 is a diagram for specifically explaining the above operation and effects and is a diagram illustrating the change in the target acceleration in a case where the driver once increases depression of the accelerator pedal 60 and thereafter returns the accelerator pedal 60. In the example in FIG. 15, after the accelerator opening increases from P1 to P2 by an increase in depression of the accelerator pedal 60, the accelerator opening lowers from P2 to P0 (<P1) by returning of the accelerator pedal 60. Such a change in the accelerator opening causes the target acceleration Ac to change in an order of Ac1, Ac2, Ac3, and then Ac4. A target acceleration Ac1 is a target acceleration at a time when the increase in depression of the accelerator pedal 60 is started and is an intermediate value between the upper limit acceleration Amax and the lower limit acceleration Amin at the accelerator opening P1 at the time point. A target acceleration Ac2 is a target acceleration at a time when the increase in depression of the accelerator pedal 60 is finished and agrees with the upper limit acceleration Amax at the accelerator opening P2 at the time point. A target acceleration Ac3 is a target acceleration at a time when the accelerator pedal 60 is returned until the accelerator opening decreases to P2 and is lower than the target acceleration Ac1 at the start of the increase in depression (almost agrees with the lower limit acceleration Amin at the acceleration opening P2, here). A target acceleration Ac4 is a target acceleration at a time when returning of the accelerator pedal 60 is finished and agrees with the lower limit acceleration Amin at the accelerator opening P0 at the time point.

In the above example, comparing the target accelerations Ac in the same accelerator opening zone from P1 to P2, the pedal-returning target acceleration (bold one-dot chain line arrow) as the target acceleration at a time when the accelerator pedal 60 is returned is lower than the depression-increasing target acceleration (bold solid line arrow) as the target acceleration at a time when depression of the accelerator pedal 60 is increased. Because such hysteresis characteristics are provided, in the present embodiment, compared to a hypothetical case where the hysteresis characteristics are not present, the change (lowering) in the acceleration of the vehicle due to returning of the accelerator pedal 60 becomes large, and the driver can be caused to properly perceive the change in the acceleration. Accordingly, because adequate responsiveness can be obtained when the accelerator pedal 60 is returned, operability of the vehicle by the accelerator pedal 60 can be improved. Further, the depression-increasing target acceleration and the pedal-returning target acceleration are set only between the characteristic curve Qx defining the upper limit acceleration Amax and the lower limit curve Qy defining the lower limit acceleration Amin. Thus, the difference between the depression-increasing target acceleration and the pedal-returning target acceleration can be prevented from being unreasonably enlarged, and discomfort of the driver can be reduced.

Further, in the present embodiment, in the hysteresis region Rh where the accelerator opening is the first opening Px1 or greater and the second opening Px2 or less, the upper limit acceleration Amax and the lower limit acceleration Amin are set such that the difference therebetween (upper-lower limit difference HA) is enlarged in a position closer to the center side of the hysteresis region Rh. That is, the upper limit acceleration Amax and the lower limit acceleration Amin are set such that the upper-lower limit difference HA becomes zero when the accelerator opening is the first opening Px1 or the second opening Px2 and the upper-lower limit difference HA is enlarged as the accelerator opening becomes closer to an intermediate value between the first opening Px1 and the second opening Px2. In such a configuration, the difference between the depression-increasing target acceleration and the pedal-returning target acceleration can continuously be changed in the hysteresis region Rh, and the target acceleration can smoothly be changed in accordance with the accelerator opening.

Further, in the present embodiment, the second internal ratio $\alpha 2$ which decreases as the road surface gradient (hill-climbing gradient) becomes larger is applied when the lower limit acceleration Amin is calculated, and the upper-lower limit difference HA is set to diminish (such that the lower limit acceleration Amin becomes closer to the upper limit acceleration Amax) as the road surface gradient is larger. Thus, a circumstance can be avoided where the opening necessary for causing the vehicle to travel at a constant speed (this will hereinafter be referred to as equilibrium opening) in hill-climbing traveling becomes non-uniform, and operability of the accelerator pedal 60 in hill-climbing traveling can be improved.

Figure 16:
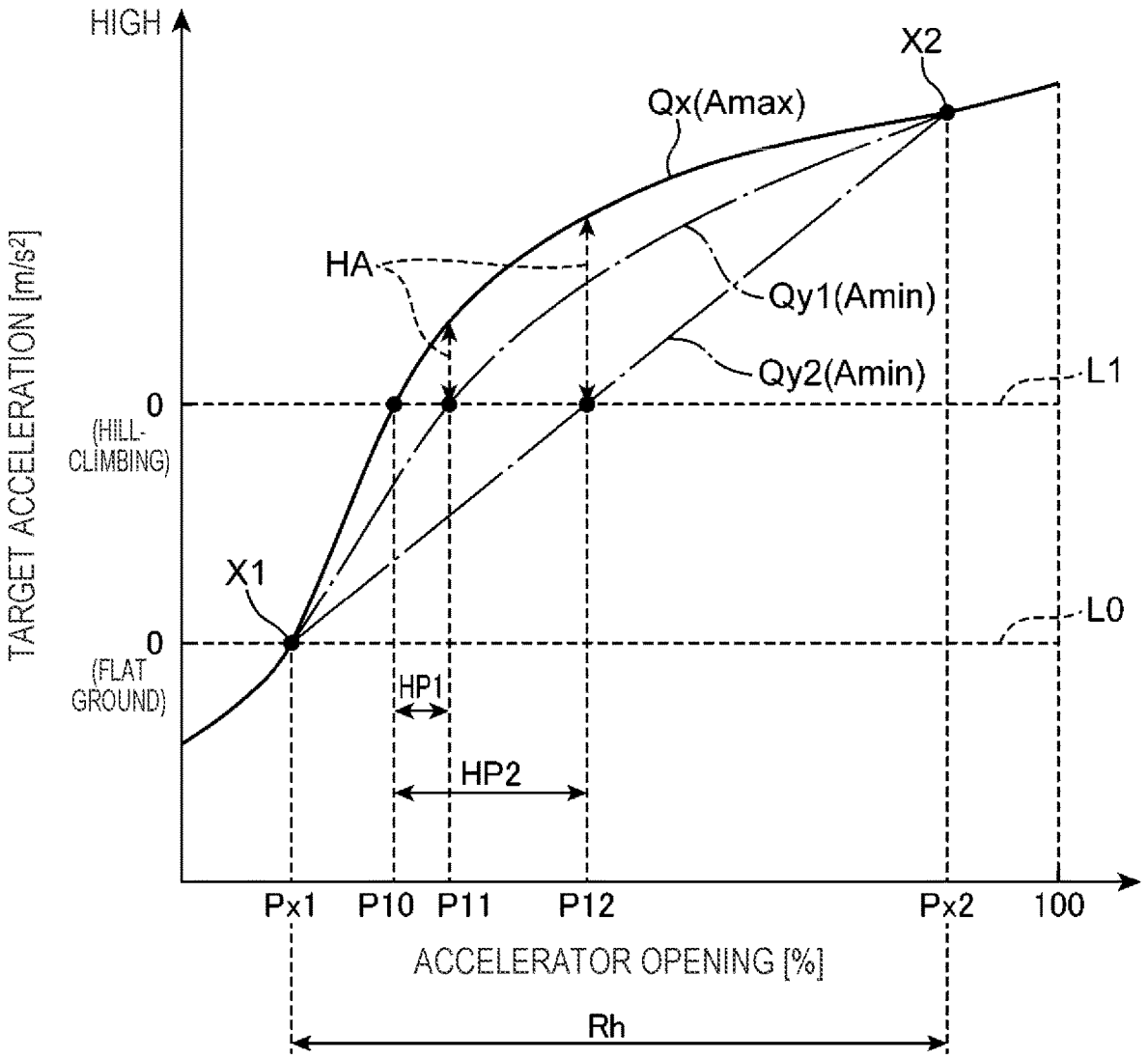
FIG. 16 is a graph illustrating the relationship between the accelerator opening and the target acceleration in hill-climbing traveling of the vehicle.

FIG. 16 is a graph illustrating the acceleration characteristics (the relationship between the accelerator opening and the target acceleration) in hill-climbing traveling. In FIG. 16, lines L0 and L1 respectively indicate constant acceleration lines on which the acceleration becomes zero (zero acceleration lines), L0 indicates a case where traveling is performed on a flat road at zero gradient, and L1 indicates a case where traveling is performed on a hill-climbing road at a positive gradient. The line L1 as the zero acceleration line in hill-climbing traveling is shifted to an upper side of the line L0 as the zero acceleration line in flat road traveling. The shifted line L1 is positioned at a height at which it crosses characteristic curves in the hysteresis region Rh. As a result, the accelerator opening necessary for causing the vehicle to travel at a constant speed (zero acceleration), in other words, the equilibrium opening becomes different between when depression of the accelerator pedal 60 is increased and when the accelerator pedal 60 is returned. This difference in the equilibrium opening between the depression-increase situation and the pedal-returning situation is enlarged as the road surface gradient becomes larger from zero (as the line L1 becomes farther from the line L0), and particularly in a case where the upper-lower limit difference HA is evenly set regardless of the road surface gradient, the above tendency becomes significant. For example, presuming that the lower limit curve Qy defining the lower limit acceleration Amin is fixed to a line Qy2 (the same as the temporary lower limit line Qy0 in FIG. 10) which linearly connects together the boundary points X1 and X2 of the hysteresis region Rh, the difference in the equilibrium opening between the depression-increasing situation and the pedal-returning situation possibly becomes a maximum of HP2. That is, in a case of employing the lower limit line Qy2 which is evenly set regardless of the road surface gradient, the difference in the equilibrium opening between the depression-increasing situation and the pedal-returning situation is possibly enlarged to a maximum of HP2 (=P12−P10) as the difference between an opening P10 on the characteristic curve Qx defining the upper limit acceleration Amax and an opening P12 on the above lower limit line Qy2. On the other hand, in a case where the lower limit acceleration Amin is set by a method of the present embodiment, in other words, in a case where a lower limit curve Qy1 which becomes closer to the characteristic curve Qx as the road surface gradient is larger is employed and the lower limit acceleration Amin is set on the lower limit curve Qy1, the difference in the equilibrium opening between the depression-increasing situation and the pedal-returning situation is enlarged only to a maximum of HP1. That is, HP1 (=P11−P10) as the difference between the opening P10 on the above characteristic curve Qx and an opening P11 on the above lower limit curve Qy1 becomes the maximum value of the difference in the equilibrium opening between the depression-increasing situation and the pedal-returning situation, and this value is less than the maximum difference HP2 of the above-described case (the case where the lower limit acceleration Amin is set regardless of the road surface gradient).

As described above, in the present embodiment, because the difference, which can occur in hill-climbing traveling, in the equilibrium opening between the depression-increasing situation and the pedal-returning situation can be diminished, discomfort which can be given to the driver in hill-climbing traveling can be reduced, and operability of the accelerator pedal 60 in hill-climbing traveling can be improved.

Further, in the present embodiment, in a case where the absolute value of the target jerk Je is the predetermined threshold value or less, in other words, in a case where the accelerator opening change rate ΔP is in a predetermined range including zero, because the internal ratio of the target acceleration Ac to the upper limit acceleration Amax and the lower limit acceleration Amin is retained at the same value as the previous value (previous internal ratio α'), the acceleration of the vehicle can gently be changed along an intention of the driver. That is, the fact that the absolute value of the accelerator opening change rate ΔP is small represents an intention of the driver of gently changing the acceleration of the vehicle. In the present embodiment, because the target acceleration Ac is set in accordance with the same internal ratio as the previous internal ratio in such a case, a sudden change in the acceleration of the vehicle can be avoided, and the driver can be prevented from feeling discomfort due to an unintended behavior change of the vehicle.

In the foregoing, the preferable embodiment of the present disclosure has been described; however, the present disclosure is not limited to the above-described embodiment, and various changes are possible without departing from the scope of the gist of the present invention.

For example, in the above embodiment, a gasoline engine as a spark ignition type internal combustion engine is used as a drive source of a vehicle; however, a drive source may be an element which can generate motive power for traveling, and a diesel engine may be used as a drive source, for example. Further, a drive source is not limited to an internal combustion engine but may be an electric motor.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

REFERENCE CHARACTER LIST

1 engine (drive source)
51 target acceleration setting unit
52 target torque setting unit
53 engine controller (drive source controller)
60 accelerator pedal
Amax upper limit acceleration
Amin lower limit acceleration
HA upper-lower limit difference
Px1 first opening
Px2 second opening
SN3 accelerator sensor
SN5 gradient sensor

The invention claimed is:

1. A vehicle control system for controlling a vehicle including a drive source which generates motive power for traveling and an accelerator pedal to be operated by a driver, the vehicle control system comprising:

an accelerator sensor which detects an accelerator opening as an opening of the accelerator pedal; and a processor configured to execute:

a target acceleration setting unit which sets a target acceleration of the vehicle based on the accelerator opening detected by the accelerator sensor;

a target torque setting unit which sets a target torque of the drive source based on the target acceleration set by the target acceleration setting unit; and a drive source controller which controls the drive source to generate the target torque set by the target torque setting unit, wherein in a case where the target acceleration at a time when the accelerator opening is increased is set as a depression-increasing target acceleration and the target acceleration at a time when the accelerator opening is decreased is set as a pedal-returning target acceleration, under a same condition of the accelerator opening, the target acceleration setting unit sets the target acceleration such that the depression-increasing target acceleration and the pedal-returning target acceleration are different from each other in a range of an upper limit acceleration or less and a lower limit acceleration or greater, the range being determined based on a map defining a relationship between the accelerator opening and the target acceleration.

2. The vehicle control system according to claim 1, wherein the target acceleration setting unit executes a control which causes the depression-increasing target acceleration and the pedal-returning target acceleration to be different in an accelerator opening range of a first opening or greater and a second opening or less, the accelerator opening range being predetermined, and in a case where a difference between the upper limit acceleration and the lower limit acceleration is set as an upper-lower limit difference, the target acceleration setting unit sets the upper limit acceleration and the lower limit acceleration such that the upper-lower limit difference becomes zero when the accelerator opening is the first opening or the second opening and the upper-lower limit difference is enlarged as the accelerator opening becomes closer to an intermediate value between the first opening and the second opening.

3. The vehicle control system according to claim 2, further comprising a gradient sensor which detects a road surface gradient as a gradient of a traveling road of the vehicle, wherein the target acceleration setting unit sets the upper limit acceleration and the lower limit acceleration such that the upper-lower limit difference diminishes as the road surface gradient detected by the gradient sensor becomes larger.

4. The vehicle control system according to claim 3, wherein when an absolute value of a change rate of the accelerator opening is less than a predetermined threshold value, the target acceleration setting unit sets the target acceleration such that an internal ratio of the target acceleration to the upper limit acceleration and the lower limit acceleration is retained at a same value as a previous value.

5. The vehicle control system according to claim 1, wherein when an absolute value of a change rate of the accelerator opening is less than a predetermined threshold value, the target acceleration setting unit sets the target acceleration such that an internal ratio of the target acceleration to the upper limit acceleration and the lower limit acceleration is retained at a same value as a previous value.

6. The vehicle control system according to claim 2, wherein when an absolute value of a change rate of the accelerator opening becomes less than a predetermined threshold value, the target acceleration setting unit sets the target acceleration such that an internal ratio of the target acceleration to the upper limit acceleration and the lower limit acceleration is retained at a same value as a previous value.

7. The vehicle control system according to claim 1, wherein the lower limit acceleration is set to a value closer to the upper limit acceleration as a vehicle speed becomes higher, and the lower limit acceleration is set to a value closer to the upper limit acceleration as a gear stage becomes higher.

8. The vehicle control system according to claim 7, wherein the lower limit acceleration is set to a value closer to the upper limit acceleration as a road surface gradient becomes larger.

9. The vehicle control system according to claim 1, wherein the lower limit acceleration is set to a value closer to the upper limit acceleration as a road surface gradient becomes larger.

10. The vehicle control system according to claim 1, wherein in a case where a change rate of an acceleration is set as a jerk and a target value of the jerk is set as a target jerk, the target acceleration setting unit calculates the target jerk from the change rate of the accelerator opening and sets the target acceleration based on an integrated value resulting from integration of the calculated target jerk.

11. The vehicle control system according to claim 10, wherein the target acceleration setting unit calculates a first correction coefficient based on an accelerator opening change rate, the target acceleration setting unit calculates a previous internal ratio based on a previous target acceleration, the upper limit acceleration, and the lower limit acceleration, in a case where the accelerator opening is retained at a constant opening, the target acceleration setting unit calculates a third correction coefficient based on the accelerator opening and a gear stage, the target acceleration setting unit calculates a fourth correction coefficient based on the gear stage and the previous internal ratio, and the target acceleration setting unit calculates the target jerk of the vehicle based on a basic jerk, the first correction coefficient, the third correction coefficient, and the fourth correction coefficient.

12. The vehicle control system according to claim 11, wherein the third correction coefficient is set to decrease as the accelerator opening becomes wider and to decrease as the gear stage becomes higher.

13. A vehicle control system for controlling a vehicle including a drive source which generates motive power for traveling and an accelerator pedal to be operated by a driver, the vehicle control system comprising:

an accelerator sensor configured to detect an accelerator opening as an opening of the accelerator pedal;

a gradient sensor configured to detect a road surface gradient as a gradient of a traveling road of the vehicle; and a processor configured to execute:

a target acceleration setting unit which sets a target acceleration of the vehicle based on the accelerator opening detected by the accelerator sensor;

a target torque setting unit which sets a target torque of the drive source based on the target acceleration set by the target acceleration setting unit; and a drive source controller which controls the drive source to generate the target torque set by the target torque setting unit, wherein the setting of the target acceleration involves:

setting an upper limit acceleration based on the accelerator opening, a vehicle speed, and a gear stage, setting a lower limit acceleration based on the accelerator opening, the vehicle speed, the gear stage, and the road surface gradient, setting a target jerk, which is a change rate of an acceleration, based on the accelerator opening, the vehicle speed, and the gear stage, and setting the target acceleration based on the target jerk, the upper limit acceleration, and the lower limit acceleration;

the upper limit acceleration is set to be higher as the accelerator opening is wider, and the upper limit acceleration is set to be lower as the gear stage is higher under a same condition of the accelerator opening;

the lower limit acceleration is set to be less than or equal to the upper limit acceleration, the lower limit acceleration is set to be higher as the accelerator opening is wider, and the lower limit acceleration is set to be lower as the vehicle speed, the gear stage, or the road surface gradient is larger;

the target jerk is set based on a basic jerk, wherein when the accelerator pedal is depressed, the basic jerk is set to be larger as a depression of the accelerator pedal is increased, and the basic jerk is set to be smaller as the depression of the accelerator pedal is decreased;

the target acceleration setting unit calculates a previous internal ratio based on a previous target acceleration, the upper limit acceleration, and the lower limit acceleration;

the target jerk is further based on a first correction coefficient, which is set to be smaller as the previous internal ratio is smaller, decreasing as the accelerator opening is wider, set to a value closer to zero when the previous target acceleration is closer to the upper limit acceleration, and set to a value closer to one when the previous target acceleration is closer to the lower limit acceleration;

when the accelerator pedal is being released or maintained at a constant degree, the target jerk is set based on the basic jerk, a second correction coefficient which becomes smaller as the accelerator opening is wider or the gear stage is higher, and a third correction coefficient which becomes smaller as either the gear stage is higher or the previous internal ratio is greater;

the target acceleration when the accelerator pedal is depressed is set as an integral value resulting from an integration of the target jerk when the accelerator pedal is depressed;

the target acceleration when the accelerator pedal is released is set as an integral value of the target jerk when the accelerator pedal is released; and when the integral value of the target jerk exceeds the upper limit acceleration, the target acceleration is set to the upper limit acceleration, and when the integral value of the target jerk is less than the lower limit acceleration, the target acceleration is set to the lower limit acceleration.

14. The vehicle control system according to claim 13, wherein when an absolute value of a rate of change of the target jerk is equal to or greater than a predetermined threshold, the target acceleration is set to the upper limit acceleration, to the lower limit acceleration, to the integral value of the target jerk when the accelerator pedal is released, or to the integral value of the target jerk when the accelerator pedal is depressed; and when an absolute value of the rate of change of the target jerk is less than the predetermined threshold, the target acceleration is set based on the upper limit acceleration, the lower limit acceleration, and the previous internal ratio.

* * * * *